US012690745B2

(12) United States Patent
Büsing et al.

(10) Patent No.: US 12,690,745 B2
(45) Date of Patent: Jul. 28, 2026

(54) DRAIN HOSE AND HOME APPLIANCE

(71) Applicant: SAMSUNG ELECTRONICS CO., LTD., Suwon-si (KR)

(72) Inventors: Johannes Büsing, Suwon-si (KR); Kwanchoul Ko, Suwon-si (KR); Jisun Yang, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 252 days.

(21) Appl. No.: 18/143,439

(22) Filed: May 4, 2023

(65) Prior Publication Data

US 2024/0000289 A1 Jan. 4, 2024

Related U.S. Application Data

(63) Continuation of application No. PCT/KR2023/004724, filed on Apr. 7, 2023.

(30) Foreign Application Priority Data

Jun. 30, 2022 (KR) ..... 10-2022-0080946

(51) Int. Cl.
*A47L 15/42* (2006.01)

(52) U.S. Cl.
CPC ..... *A47L 15/4223* (2013.01); *A47L 15/4225* (2013.01)

(58) Field of Classification Search
CPC . D06F 39/083; A47L 15/4223; A47L 15/4225
See application file for complete search history.

(56) References Cited

U.S. PATENT DOCUMENTS 459,951 A * 9/1891 Warner ..... F16L 37/252 439/352
5,181,535 A * 1/1993 Scaramucci ..... F16K 27/0227 137/515.5

(Continued)

FOREIGN PATENT DOCUMENTS

EP 0 715 110 B1 7/1997
JP 2973168 11/1999

(Continued)

OTHER PUBLICATIONS

International Search Report dated Jul. 31, 2023 issued in PCT Application No. PCT/KR2023/004724.

(Continued)

*Primary Examiner* — David G Cormier
(74) *Attorney, Agent, or Firm* — STAAS & HALSEY LLP

(57) ABSTRACT

A dishwasher includes a tub, a drain housing to drain wash water in the tub, a drain pump detachably coupled to the drain housing, the drain pump configured to pump the wash water, a drain port formed on one side of the drain housing, the drain port comprising a port body to allow the wash water pumped by the drain pump to flow, and a locking portion formed on an outer surface of the port body, and a drain hose to drain wash water discharged from the drain port to an outside of the dishwasher, the drain hose comprising a hose body and a drain connector at one end of the hose body and connectable to the drain port. The drain connector includes a locking hook to be locked to the locking portion in response to inserting the drain connector into the port body.

20 Claims, 24 Drawing Sheets

(56) References Cited

U.S. PATENT DOCUMENTS

| | | | | |
|---|---|---|---|---|
| 5,609,370 | A * | 3/1997 | Szabo | F16L 37/0985 285/921 |
| 8,512,482 | B2 | 8/2013 | Büsing | |
| 9,476,157 | B2 | 10/2016 | Park et al. | |
| 11,241,139 | B2 | 2/2022 | Jaske et al. | |
| 2008/0093846 | A1* | 4/2008 | Sparks | F16L 37/098 285/330 |
| 2010/0037927 | A1* | 2/2010 | Busing | A47L 15/4217 137/511 |
| 2017/0354306 | A1* | 12/2017 | Cho | A47L 15/0031 |
| 2020/0337519 | A1 | 10/2020 | Büsing et al. | |

FOREIGN PATENT DOCUMENTS

| | | |
|---|---|---|
| JP | 2000-51134 | 2/2000 |
| JP | 2014-190473 | 10/2014 |
| JP | 6570299 | 9/2019 |
| KR | 20-1996-0008038 | 3/1996 |
| KR | 1996-0008038 | 9/1996 |
| KR | 1999-0030770 | 7/1999 |
| KR | 10-2011-0022236 | 3/2011 |
| KR | 10-1564597 | 10/2015 |
| KR | 10-2020-0124976 | 11/2020 |
| KR | 10-2021-0082809 | 7/2021 |
| KR | 10-2021-0157633 | 12/2021 |
| KR | 10-2348039 | 1/2022 |

OTHER PUBLICATIONS

Written Opinion dated Jul. 31, 2023 issued in PCT Application No. PCT/KR2023/004724.

Supplementary European Search Report dated May 27, 2025 issued European Application No. EP 23 83 1683.

* cited by examiner

DRAIN HOSE AND HOME APPLIANCE

CROSS REFERENCE TO THE RELATED APPLICATION

This application is a continuation application, filed under 35 U.S.C. § 111(a), of International Application PCT/KR2023/004724 filed Apr. 7, 2023, and is based on and claims priority under 35 U.S.C. § 119 to Korean Patent Application No. 10-2022-0080946, filed on Jun. 30, 2022, in the Korean Intellectual Property Office. The disclosure of which is incorporated by reference herein in its entirety.

BACKGROUND

1. Field

The disclosure relates to a drain hose and a home appliance including an improved structure.

2. Description of Related Art

Home appliances may have a drainage function to drain internal water. For example, home appliances having such a drainage function may include a dishwasher for washing dishes and a washing machine for washing clothes.

For example, wash water used in a washing process may be drained to the outside of the home appliance through a drain port and a drain hose. The drain hose may be connected to the drain port to guide the wash water.

In general, a fixing member such as a clamp may be required to prevent the drain hose from being separated from the drain port.

Meanwhile, an undercut may be provided at an end of the drain hose to fix a component such as a sealing member, and the drain hose may be manufactured by a divided mold. At this time, a parting line corresponding to a dividing surface of the mold may be formed on a surface of the drain hose that is taken out of the mold.

SUMMARY

In accordance with an aspect of the disclosure, a dishwasher includes a tub, a drain housing to drain wash water of the tub, a drain pump detachably coupled to the drain housing and configured to pump the wash water, a drain port formed on one side of the drain housing, and including a port body to allow the wash water pumped by the drain pump to flow, and a locking portion formed on an outer surface of the port body, and a drain hose to drain the wash water discharged from the drain port to an outside of the dishwasher, and the drain hose comprising a hose body and a drain connector at one end of the hose body and connectable to the drain port. The drain connector includes a locking hook to be locked to the locking portion in response to inserting the drain connector into the port body.

The locking portion may include a first inclined portion. The locking hook may include a second inclined portion to be moved along the first inclined portion in response to the inserting of the drain connector into the port body.

The drain hose may include a check valve configured to prevent a back flow of the wash water, and a holder to fix the check valve to an inside of the drain connector and detachably coupled to one end of the drain connector.

The holder may include a holder body disposed inside the drain connector, and a holder flange extending from one end of the holder body to cover the one end of the drain connector.

The drain connector may further include a coupling protrusion protruding from the one end of the drain connector. The holder flange may further include a protrusion insertion portion into which the coupling protrusion is inserted.

The check valve may include a valve body detachably coupled to an inner surface of the drain connector. The check valve may include a flap to pivot with respect to the valve body to open or close a drain flow path formed inside the drain connector.

The holder may include a holder body disposed inside the drain connector, and a holder flange extending from an other end of the holder body. The holder flange may include a first sealing extension portion to be in close contact with the valve body, and a second sealing extension portion to be in close contact with the flap.

The holder flange may further include a groove portion to be recessed between the first sealing extension portion and the second sealing extension portion.

The check valve may include a mounting portion formed on an inner surface of the valve body to be in contact with an end of the first sealing extension portion. The check valve may include a sealing inclined portion obliquely extending from the mounting portion to be in contact with an outer surface of the first sealing extension portion.

The drain hose may further include a sealing member to seal between the drain port and the drain connector. The holder may further include a first side portion disposed on one side of the sealing member to limit a movement of the sealing member in one direction. The drain connector may further include a second side portion disposed on an other side of the sealing member to limit a movement of the sealing member in a direction opposite to the one direction.

The check valve may include a first coupler formed in a lower portion of a side, which faces the holder, in the valve body. The holder may include a second coupler to correspond to the first coupler.

The check valve may further include a hinge to connect the valve body with the flap, the hinge formed in an upper portion of a side that is opposite to the one side of the valve body.

The drain port may further include a guide portion to guide a movement of the drain connector in response to inserting the drain connector into the port body, the guide portion to limit a rotation of the drain connector in response to the inserting of the drain connector into the port body.

The check valve may further include at least one of a first sealing protrusion to be in contact with the inner surface of the drain connector, or a second sealing protrusion be in contact with an outer surface of the holder.

The locking hook may be locked to the locking portion in response to inserting into and rotating the locking hook in the port body.

In accordance with another aspect of the disclosure, a home appliance includes a main body, a tub disposed inside the main body to form a washing chamber, a drain port including a port body connected to the tub, and a locking portion formed on an outer surface of the port body, and a drain hose to guide wash water inside the drain port to an outside of the home appliance, and including a hose body and a drain connector at one end of the hose body and coupled to the drain port in a first direction. The drain connector further includes a locking hook to be locked to the locking portion in a second direction opposite to the first direction in response to the drain connector being inserted into the port body.

The home appliance may include a check valve configured to open and close a flow path formed in the drain connector and a holder to fix the check valve to the drain connector. The holder may include a holder body, a first extension portion formed on one side of the holder body and to cover one end of the drain connector, and a second extension portion extending from the first extension portion to cover an outer surface of the drain connector.

The drain connector may further include a coupling protrusion extending from one end of the drain connector. The holder may further include a protrusion insertion portion formed in the first extension portion to allow the coupling protrusion to be inserted thereinto.

The coupling protrusion may be in plurality, and at least one of the plurality of coupling protrusions may have a shape different from the rest of the plurality of coupling protrusions.

The home appliance may further include a side portion spaced apart from the second extension portion with respect to a flow direction of the wash water and protruding from an outer surface of the drain connector. The home appliance may further include a sealing member detachably coupled to the outer surface of the drain connector to be disposed between the side portion and the second extension portion.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Figure 1:
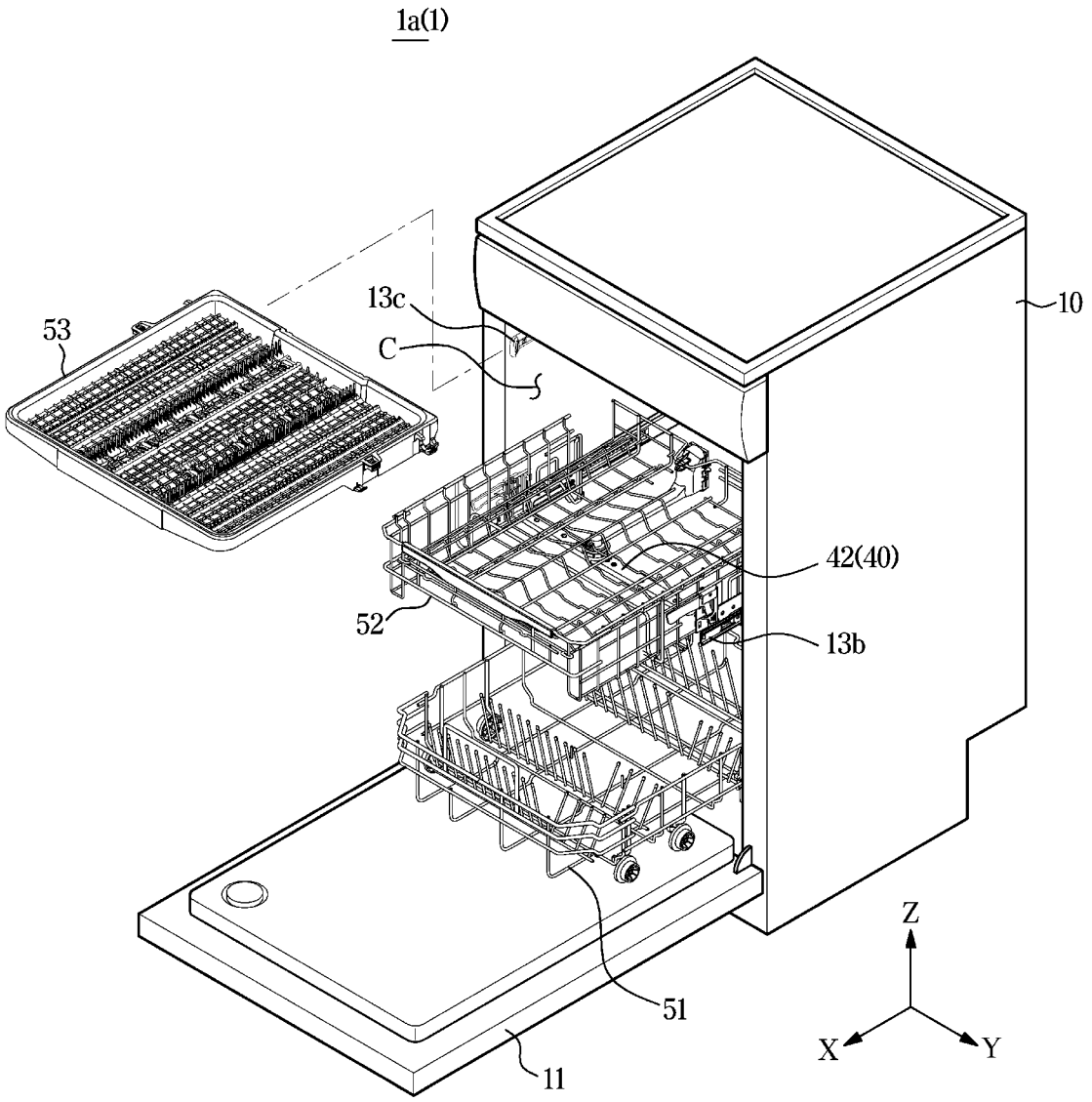
FIG. 1 is a schematic perspective view of a dishwasher according to an embodiment.

Embodiments described in the disclosure and configurations illustrated in the drawings are merely examples of the embodiments of the disclosure, and may be modified in various different ways at the time of filing of the present application to replace the embodiments and drawings of the disclosure.

In addition, the same reference numerals or signs illustrated in the drawings of the disclosure indicate elements or components performing substantially the same function.

Also, the terms used herein are used to describe the embodiments and are not intended to limit and/or restrict the disclosure. The singular forms "a," "an" and "the" are intended to include the plural forms as well, unless the context clearly indicates otherwise. In this disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

It will be understood that when an element is referred to as being "connected" another element, it can be directly or indirectly connected to the other element. Similarly, it will be understood that when an element is referred to as being "coupled" another element, it can be directly or indirectly coupled to the other element.

Throughout the description, when a member is located "on" another member, this includes not only when the member is in contact with the other member, but also when there is another member between the two members.

It will be understood that, although the terms first, second, third, etc., may be used herein to describe various elements, but elements are not limited by these terms. These terms are only used to distinguish one element from another element. For example, without departing from the scope of the disclosure, a first element may be termed as a second element, and a second element may be termed as a first element. The term of "and/or" includes a plurality of combinations of relevant items or any one item among a plurality of relevant items.

Meanwhile, the terms"front and rear direction", "front side", "rear side", "upper side", and "lower side" used in the following description are defined based on the drawings, but the shape and position of each component are not limited by this term.

Figure 2:
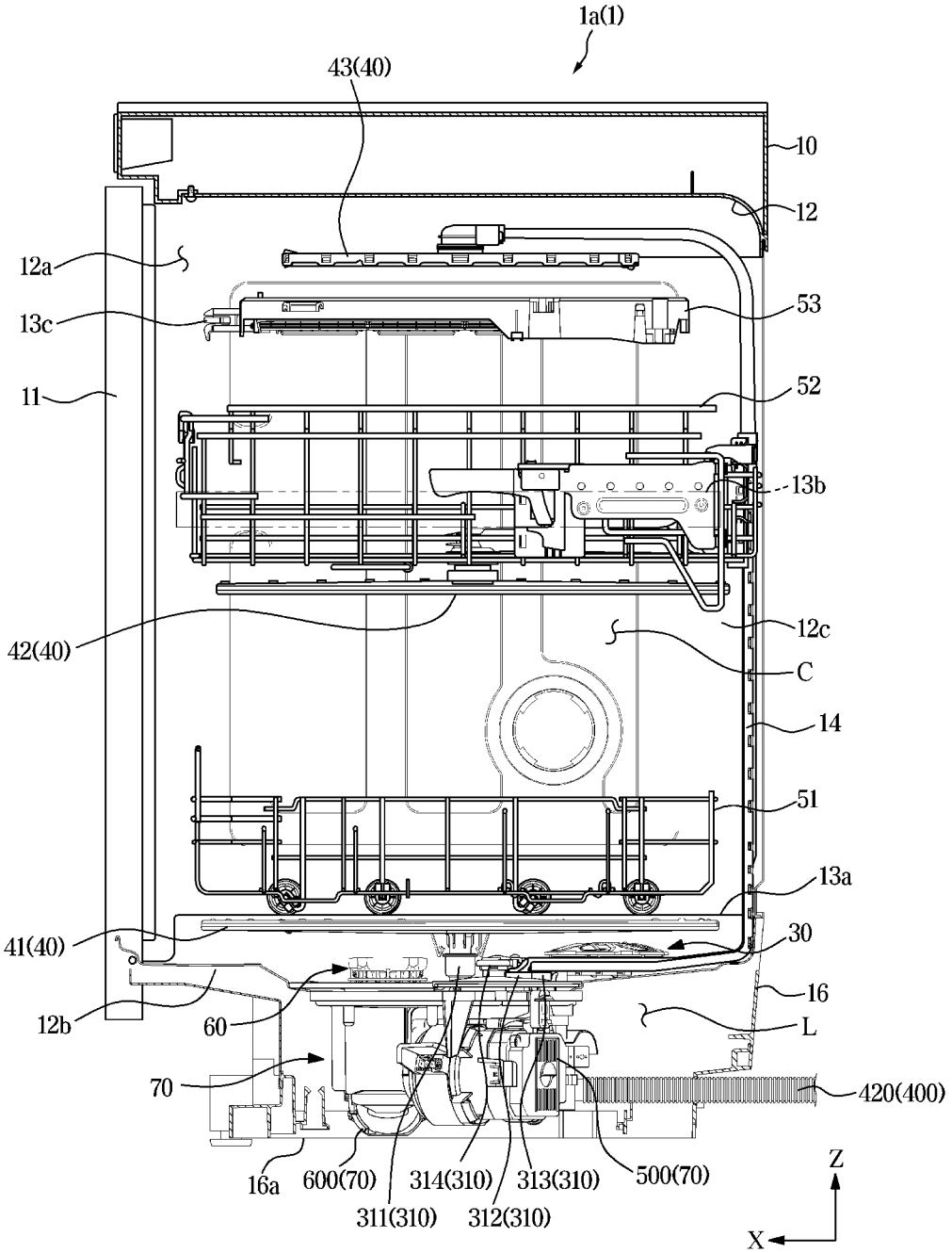
FIG. 2 is a schematic side cross-sectional view of the dishwasher according to an embodiment.

For example, referring to FIGS. 1 and 2, "up and down direction", "height direction", and "vertical direction" may mean the Z direction. "Horizontal direction" may mean any direction along the X-Y plane. However, the above description is merely illustrative, and is not limited thereto.

Hereinafter an embodiment according to the disclosure will be described in detail with reference to the accompanying drawings.

Therefore, it is an aspect of the disclosure to provide a drain hose and a home appliance including an improved structure.

It is another aspect of the disclosure to provide a drain hose capable of being easily coupled to a drain port without a separate fixing member, and a home appliance including the same.

It is another aspect of the disclosure to a drain hose capable of being manufactured without a parting line and a home appliance including the same.

It is another aspect of the disclosure to provide a drain hose and a home appliance having an improved assemblability.

Additional aspects of the disclosure will be set forth in part in the description which follows and, in part, will be obvious from the description, or may be learned by practice of the disclosure.

The disclosure relates to a drain hose 420 and a home appliance 1 including the drain hose 420. The home appliance 1 may include a dishwasher, a washing machine, and the like. In FIGS. 1 to 23, an example 1*a* of the dishwasher may be described. In FIG. 24, an example 1*b* of the washing machine may be described. However, it is not limited thereto, and the drain hose 420 according to the disclosure may be applied to all home appliances having a drainage function. For example, the drain hose 420 may be applied to an outdoor unit, an indoor unit, a humidifier, a dryer, etc. in terms of draining water remaining inside a main body to the outside.

FIG. 1 is a schematic perspective view of a dishwasher according to an embodiment. FIG. 2 is a schematic side cross-sectional view of the dishwasher according to an embodiment.

Referring to FIGS. 1 and 2, a dishwasher 1*a* may include a main body 10. The main body 10 may form an exterior of the dishwasher 1*a*.

The dishwasher 1*a* may include a tub 12 provided inside the main body 10. The tub 12 may be formed in a substantially box shape. One side of the tub 12 may be openable. That is, the tub 12 may include an opening 12*a*. As an example, a front surface of the tub 12 may be openable.

The dishwasher 1 may include a door 11 configured to open and close the opening 12*a* of the tub 12. The door 11 may be installed in the main body 10 to open and close the opening 12*a* of the tub 12. The door 11 may be rotatably installed in the main body 10. The door 11 may be removably mounted to the main body 10.

The dishwasher 1*a* may further include a storage container provided inside the tub 12 to accommodate dishes.

The storage container may include a plurality of baskets 51, 52 and 53. The plurality of baskets 51, 52, and 53 may be provided to store various tableware. However, it is not limited thereto, and the storage container may include a single basket.

The storage container may include an intermediate basket 52 positioned in the middle with respect to the height direction of the dishwasher 1*a*, and a lower basket 51 positioned in a lower portion with respect to the height direction of the dishwasher 1*a*. The intermediate basket 52 may be provided to be supported by an intermediate guide rack 13*b*. The lower basket 51 may be provided to be supported by a lower guide rack 13*a*. The intermediate guide rack 13*b* and the lower guide rack 13*a* may be installed on a side surface 12*c* of the tub 12 so as to be slidable toward the opening 12*a* of the tub 12. The side surface 12*c* of the tub 12 may include an inner surface of a right wall and/or an inner surface of a left wall of the tub 12.

Relatively large dishes may be stored in the plurality of baskets 51 and 52. However, the kind of dishes accommodated in the plurality of baskets 51 and 52 is not limited to relatively large dishes. That is, the plurality of baskets 51 and 52 may accommodate not only relatively large dishes but also relatively small dishes.

The storage container may include an upper basket 53 positioned in an upper portion with respect to the height direction of the dishwasher 1*a*. The upper basket 53 may be formed in a rack assembly to accommodate relatively small dishes. For example, the upper basket 53 may contain a cooking utensil such as a ladle, a knife, or a turner, or cutlery. In addition, the upper basket 53 may accommodate a small cup such as an espresso cup. However, the kind of dishes accommodated in the upper basket 53 is not limited thereto.

The upper basket 53 may be provided to be supported by an upper guide rack 13*c*. The upper guide rack 13*c* may be installed on the side surface 12*c* of the tub 12. For example, the upper basket 53 may be slidably moved by the upper guide rack 13*c*, and inserted into or withdrawn from a washing chamber C.

The dishwasher 1*a* may include the washing chamber C that is a space formed inside the tub 12. The washing chamber C may be defined as an inner space of the tub 12. The washing chamber C may refer to a space in which dishes placed in the storage container are washed by wash water and dried.

The dishwasher 1*a* may include a spray device 40 configured to spray wash water. The spray device 40 may spray wash water into the washing chamber C. The spray device 40 may spray the wash water toward the dishes stored in the storage container. The spray device 40 may receive wash water from a sump assembly 70 to be described later.

The spray device 40 may include at least one spray unit. The spray device 40 may include one spray unit or a plurality of spray units 41, 42, and 43.

For example, the plurality of spray units 41, 42, and 43 may include a first spray unit 41 disposed under the lower basket 51 in the height direction of the dishwasher 1*a*, a second spray unit 42 disposed under the intermediate basket 52 in the height direction of the dishwasher 1*a*, and a third spray unit 43 disposed above the upper basket 53 in the height direction of the dishwasher 1*a*. However, it is not limited thereto, and two or four or more of spray units may be provided.

Each of the plurality of spray units 41, 42, and 43 may be provided to spray wash water while rotating. Each of the first spray unit 41, the second spray unit 42, and the third spray unit 43 may be provided to spray wash water while rotating. The plurality of spray units 41, 42 and 43 may be referred to as a plurality of spray rotors. The first spray unit 41, the second spray unit 42, and the third spray unit 43, respectively, may be referred to as a first spray rotor 41, a second spray rotor 42, and a third spray rotor 43.

However, the spray device 40 may spray the wash water in a manner different from the above-described example. For example, unlike the second spray unit 42 and the third spray unit 43, the first spray unit 41 may be fixed to one side of a lower surface 12*b* of the tub 12. At this time, the first spray unit 41 may be provided to spray the wash water in a substantially horizontal direction by a fixed nozzle, and a direction of the wash water, which is sprayed in a substantially horizontal direction from the nozzle of the first spray unit 41, may be changed by a conversion assembly (not shown) disposed inside the washing chamber C, and then move upward. The conversion assembly may be installed on a rail (not shown) and may be provided to be movable in translation along the rail. Meanwhile, although the first spray unit 41 is described as an example, the second spray unit 42 and the third spray unit 43 may also be provided to spray wash water using fixed nozzles, similar to the above-described example.

The dishwasher 1 may include an auxiliary spray device 30. The auxiliary spray device 30 may be disposed at one side of a lower portion of the washing chamber C to spray wash water to a partial region of the washing chamber C. The auxiliary spray device 30 may be designed to spray relatively high-pressure water compared to the spray device 40, and the auxiliary spray device 30 may intensively wash heavily soiled dishes. The auxiliary spray device 30 may be referred to as an auxiliary spray unit 30. It is possible to omit the auxiliary spray device 30.

The dishwasher 1*a* may include the sump assembly 70.

The sump assembly 70 may be provided to receive wash water. The sump assembly 70 may collect wash water of the washing chamber C. For example, the lower surface 12*b* of the tub 12 may be inclined downward toward the sump assembly 70 to smoothly collect water to the sump assembly 70. The wash water of the washing chamber C may flow along the slope of the lower surface 12*b* of the tub 12 and smoothly flow into the sump assembly 70.

The dishwasher 1*a* may include a circulation pump 500 configured to pump wash water stored in the sump assembly 70 to the spray device 40. The circulation pump 500 may be provided as one component of the sump assembly 70.

The dishwasher 1*a* may include a drain pump 600 configured to drain wash water and foreign substances (e.g., food waste) remaining in the sump assembly 70. The drain pump 600 may be provided as one component of the sump assembly 70.

The sump assembly 70 may pump the collected wash water and supply the wash water to the spray device 40. The sump assembly 70 may pump the collected wash water and supply the wash water to the auxiliary spray device 30. The sump assembly 70 may include a connection port 310 connected to the spray device 40 to supply wash water to the spray device 40 and/or the auxiliary spray device 30. For example, the connection port 310 may be formed in a sump cover 300 (refer to FIG. 3) to be described later.

For example, referring to FIG. 2, the connection port 310 may include a first connection port 311 connected to the first spray unit 41, a second connection port 312 connected to the second spray unit 42, and a third connection port 313 connected to the third spray unit 43. The second connection port 312 may be connected to the second spray unit 42 through a first duct. The third connection port 313 may be connected to the third spray unit 43 through a second duct. The first duct and the second duct may be provided as separate ducts or as a single duct 14 as shown in FIG. 2. The duct 14 may include a shape extending in the height direction.

For example, the connection port 310 may include a fourth connection port 314 connected to the auxiliary spray device 30. The fourth connection port 314 may be omitted depending on the presence and absence of the auxiliary spray device 30.

The dishwasher 1*a* may include a machine room L that is a space provided below the tub 12. The machine room L may be a place in which a component for circulating wash water is disposed. The dishwasher 1*a* may include a base frame 16 forming the machine room L.

For example, at least a part of the sump assembly 70 may be disposed in the machine room L. Most of the sump assembly 70 may be disposed in the machine room L. That is, an area of the sump assembly 70 located in the washing chamber C may be less than an area of the sump assembly 70 located in the machine room L. By reducing the area of the sump assembly 70 occupying the washing chamber C, the area of the washing chamber C may be secured. Accordingly, a capacity of the washing chamber C may be increased, and thus a storage capacity of the dishes may be improved.

The dishwasher 1*a* may include a filter assembly 60. The filter assembly 60 may be provided to filter out foreign substances included in the wash water flowing into the sump assembly 70. The filter assembly 60 may be detachably mounted on a sump housing 100. At least a portion of the filter assembly 60 may be disposed inside a water storage chamber 111 (refer to FIG. 3) to be described later. For example, the filter assembly 60 may include at least one of a fine filter, a coarse filter, and a micro filter.

Figure 3:
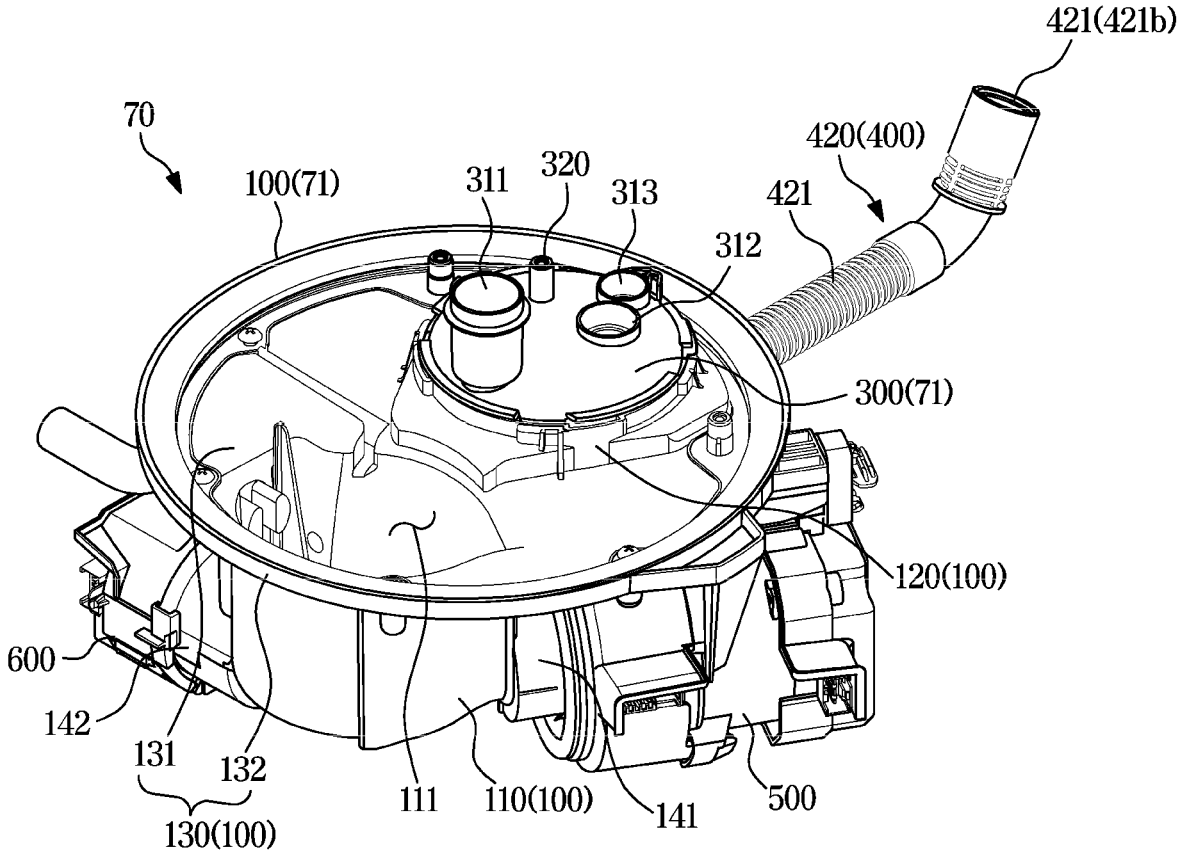
FIG. 3 is a perspective view of a sump assembly of the dishwasher according to an embodiment.
Figure 4:
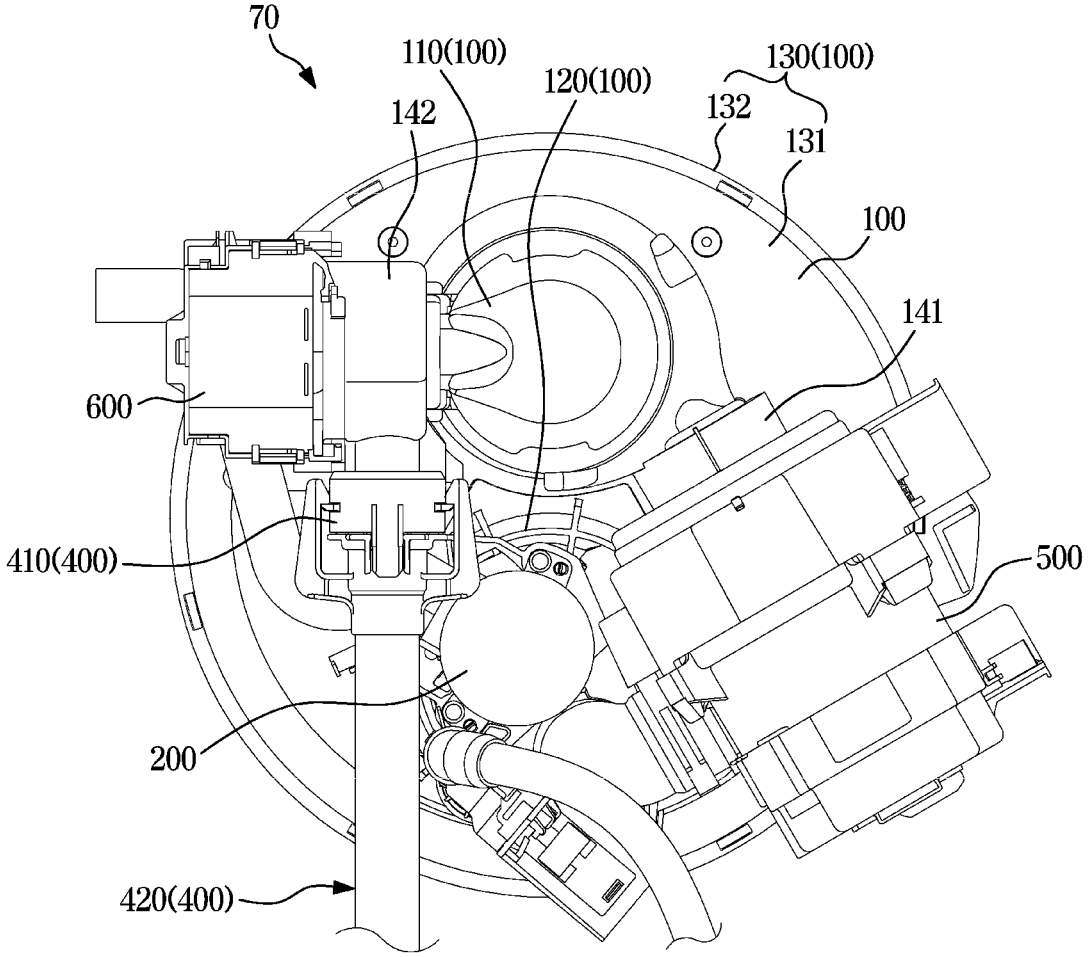
FIG. 4 is a bottom view of the sump assembly shown in FIG. 3.

FIG. 3 is a perspective view of a sump assembly of the dishwasher according to an embodiment. FIG. 4 is a bottom view of the sump assembly shown in FIG. 3.

The sump assembly 70 may include a sump body 71. The sump body 71 may form an exterior of the sump assembly 70. Components for collecting, circulating, and supplying wash water may be detachably mounted on the sump body 71.

For example, the sump body 71 may include the sump housing 100 and the sump cover 300.

The sump housing 100 may be provided to accommodate wash water.

The sump housing 100 may include the water storage chamber 111 provided to store wash water. The water storage chamber 111 may have an open top shape. The water storage chamber 111 may be provided to receive wash water introduced from a water supply pipe (not shown) or to receive wash water introduced from the tub 12.

The sump housing 100 may include a distribution chamber 121 in which wash water supplied to the spray device 40 is accommodated. The distribution chamber 121 may be partitioned from the water storage chamber 111. The distribution chamber 121 may receive the wash water stored in the water storage chamber 111.

Wash water received in the distribution chamber 121 may be distributed to the spray device 40 through a distribution device 200 (refer to FIG. 4). The distribution device 200 may allow the plurality of spray units to selectively supply the wash water. The distribution device 200 may be detachably mounted to the sump housing 100. The distribution device 200 may be provided as one component of the sump assembly 70. However, it is not limited thereto, and the distribution device 200 may be provided as a separate component from the sump assembly 70.

For example, the sump housing 100 may include a first sump body 110 provided to form the water storage chamber 111 and a second sump body 120 provided to form the distribution chamber 121.

For example, the sump housing 100 may include a third sump body 130. The third sump body 130 may refer to an exterior of the sump housing 100 excluding the first sump body 110 and the second sump body 120.

For example, the third sump body 130 may include a base 131 connecting the first sump body 110 and the second sump body 120. The third sump body 130 may include a rim 132 protruding upward from an outer edge of the base 131.

The sump cover 300 may be provided to cover the sump housing 100. The sump cover 300 may be provided to cover a part of an upper portion of the sump housing 100. The sump cover 300 may include the connection port 310.

The sump assembly 70 may include the circulation pump 500. The circulation pump 500 may be configured to pump the wash water stored in the sump housing 100, and transfer the wash water to the spray device 40. The circulation pump 500 may be detachably mounted on the sump housing 100. The circulation pump 500 may be detachably mounted on a circulation pump connector 141 of the sump housing 100. The circulation pump 500 may communicate with the water storage chamber 111. The circulation pump 500 may be disposed in the machine room L.

The sump assembly 70 may include the drain pump 600. The drain pump 600 may be configured to drain wash water and foreign substances remaining in the sump housing 100. The drain pump 600 may be detachably mounted on the sump housing 100. The drain pump 600 may be detachably coupled to a drain pump connector 142 of the sump housing 100. The drain pump 600 may be provided to communicate with the water storage chamber 111. The drain pump 600 may be located at the lowest position among components of the sump assembly 70 for smooth drainage. The drain pump 600 may be disposed in the machine room L.

For example, the drain pump 600 may be provided as one component of a drainage device 400 to be described later. For example, the drain pump connector 142 may be provided as one component of the drainage device 400 to be described later.

Referring to FIGS. 3 and 4, the dishwasher 1*a* (or the home appliance 1) may include a drain housing. The drain housing may be provided to drain the wash water of the tub 12. For example, the drain housing may be provided as one component of the sump assembly 70. For example, the drain housing may be provided as one component of the sump housing 100.

For example, the drain housing may include the drain pump connector 142. The drain pump 600 may be detachably mounted to the drain pump connector 142. The drain pump connector 142 may be connected to the water storage chamber 111.

It is illustrated that the drain pump connector 142 is formed integrally with the water storage chamber 111 in the drawings, but is not limited thereto. For example, the drain pump connector 142 may be provided as a separate component from the water storage chamber 111. For example, the drain pump connector 142 may be connected to the water storage chamber 111 by an intermediate member (e.g., a connection hose).

For example, the drain housing may include a drain port 410 to be described later. A drain hose 420 for draining wash water to the outside may be detachably mounted on the drain port 410. The drain port 410 may be provided to be connected to the water storage chamber 111.

It is illustrated that the drain port 410 is formed integrally with the water storage chamber 111 in the drawings, but is not limited thereto. For example, the drain port 410 may be provided as a separate component from the water storage chamber 111. For example, the drain port 410 may be connected to the water storage chamber 111 by an intermediate member (e.g., a connection hose).

The drain pump connector 142 and the drain port 410 may be integrally formed. The drain pump connector 142 and the drain port 410 may be provided as separate components and connected to each other.

Meanwhile, the drain housing may be applied not only to the dishwasher 1*a* but also to the washing machine 1*b* to be described later.

Figure 5:
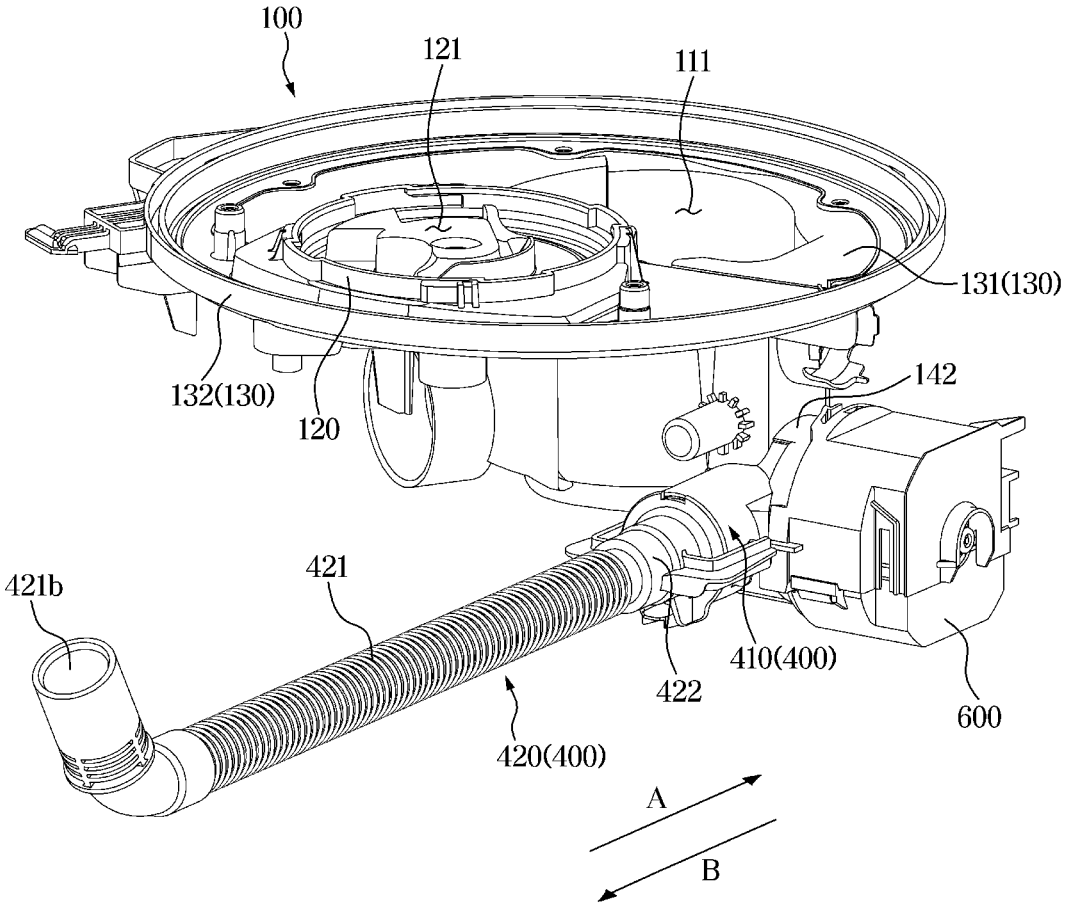
FIG. 5 is a view illustrating a state in which a sump housing, a drain hose, and a drain pump of the dishwasher according to an embodiment are coupled.
Figure 6:
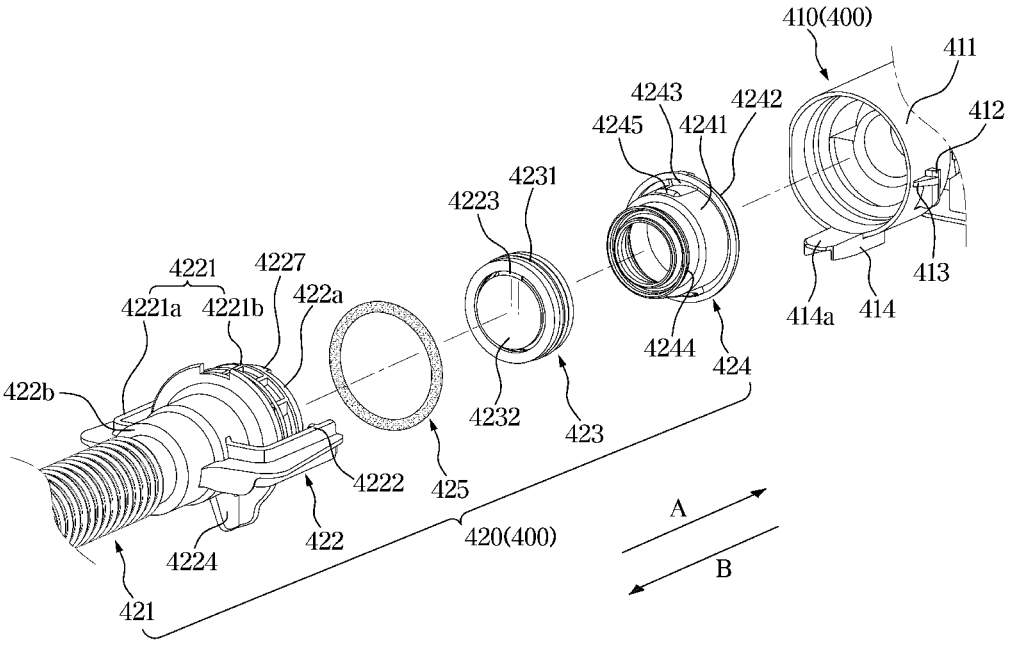
FIG. 6 is an exploded view of an example of a drainage device according to an embodiment.
Figure 7:
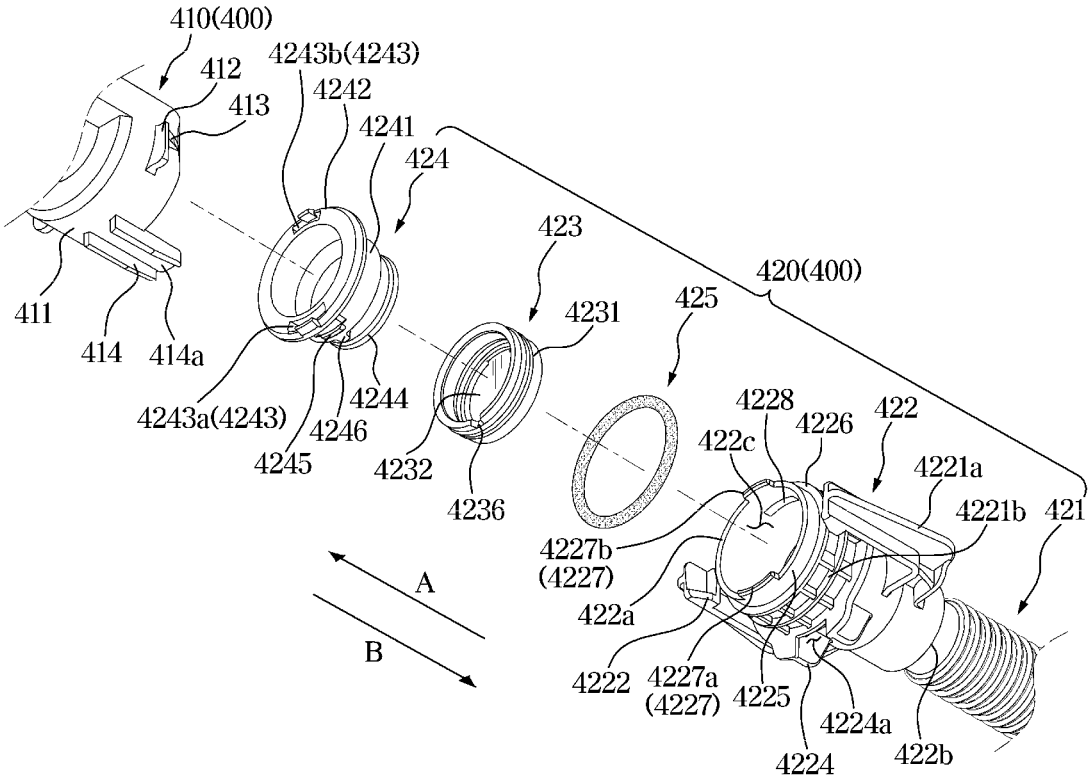
FIG. 7 is an exploded view of the drainage device shown in FIG. 6 when viewed from another direction.
Figure 8:
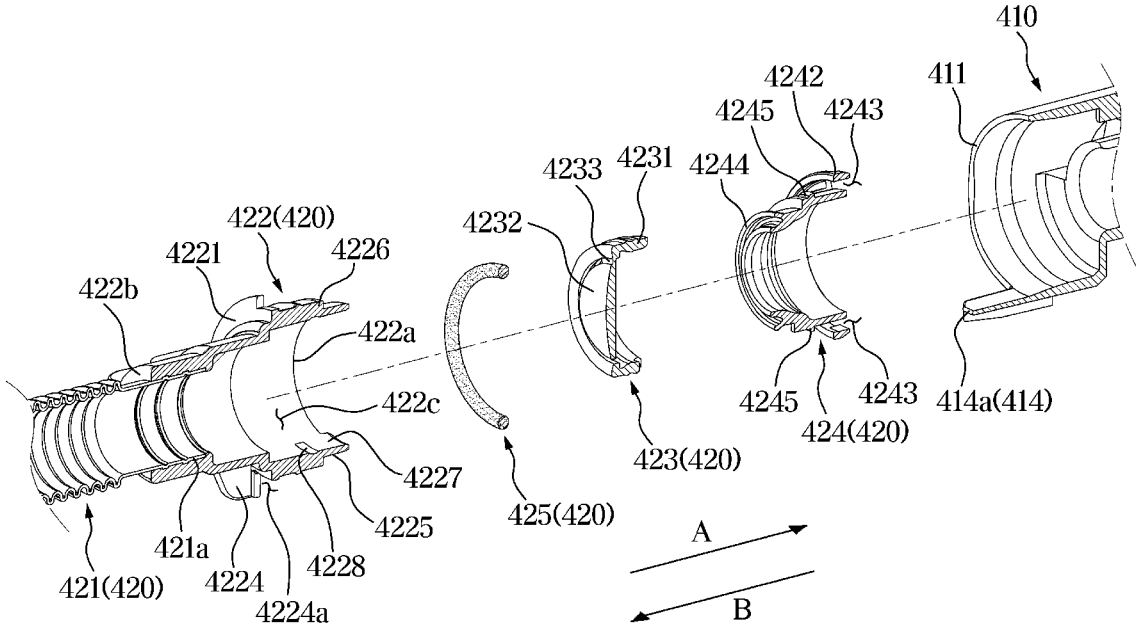
FIG. 8 is a cut-away exploded view of the drainage device shown in FIG. 6.
Figure 9:
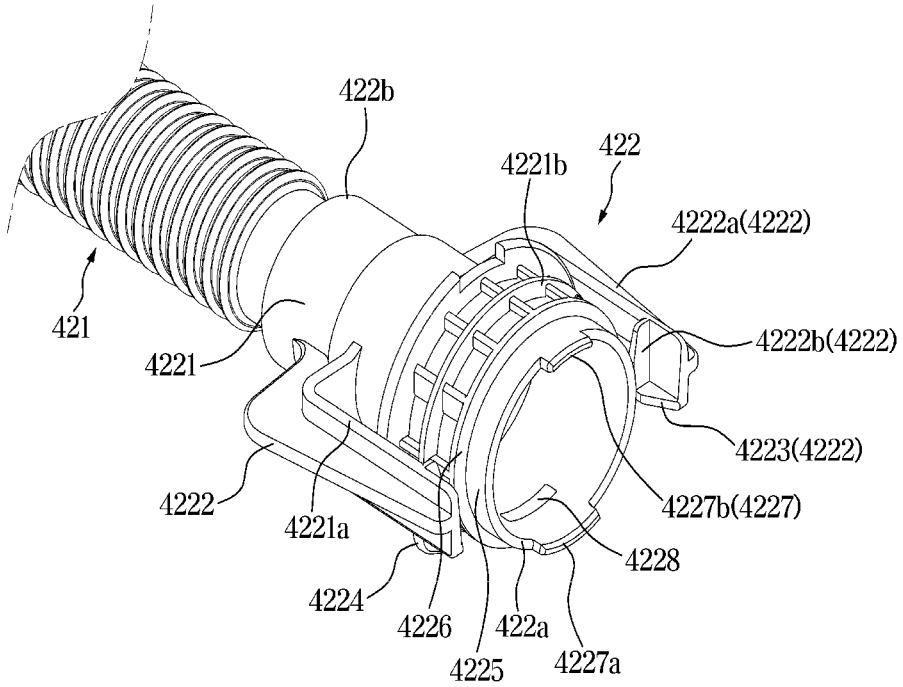
FIG. 9 is a perspective view of a hose body and a drain connector of the drain hose according to an embodiment.
Figure 10:
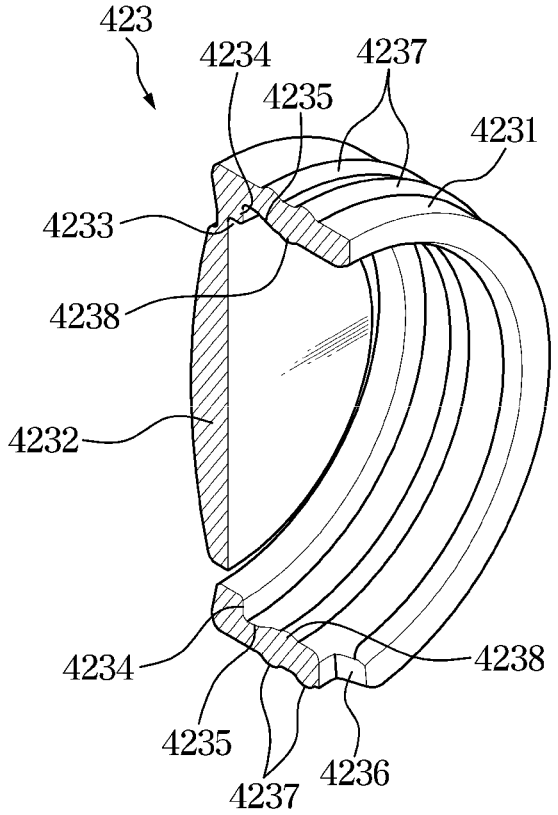
FIG. 10 is a cut-away perspective view of a check valve of the drain hose according to an embodiment.
Figure 11:
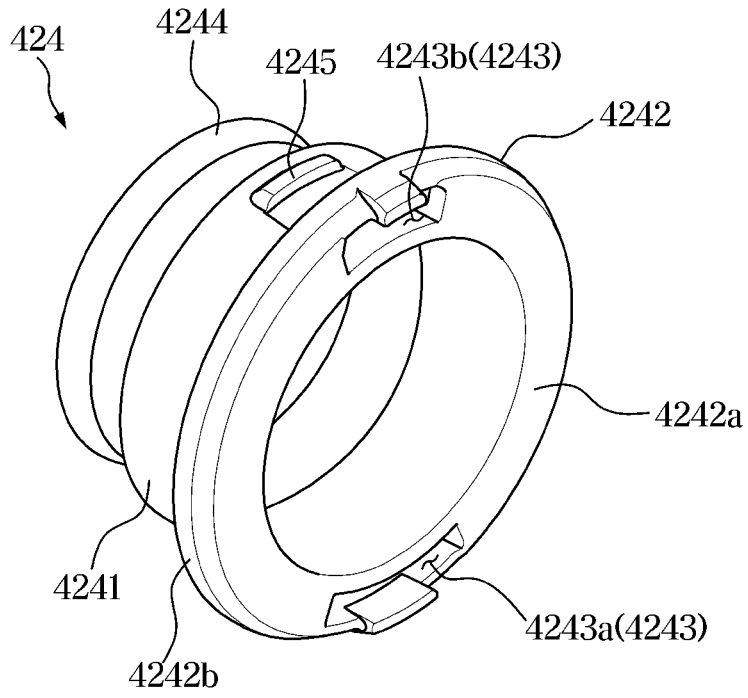
FIG. 11 is a perspective view of a holder of the drain hose according to an embodiment.
Figure 12:
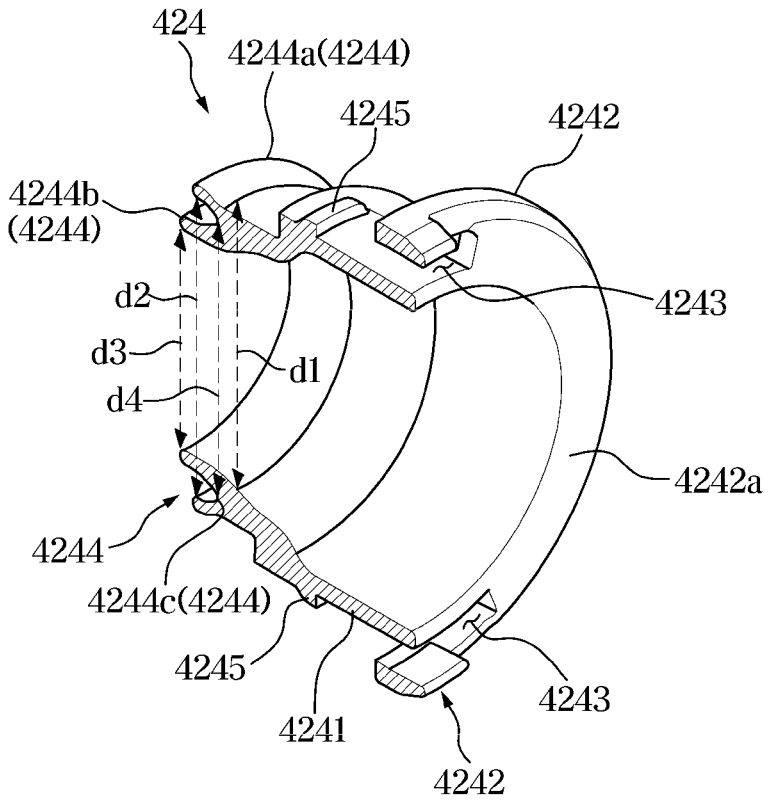
FIG. 12 is a cut-away perspective view of the holder of the drain hose shown in FIG. 11.

FIG. 5 is a view illustrating a state in which a sump housing, a drain hose, and a drain pump of the dishwasher according to an embodiment are coupled. FIG. 6 is an exploded view of an example of a drainage device according to an embodiment. FIG. 7 is an exploded view of the drainage device shown in FIG. 6 when viewed from another direction. FIG. 8 is a cut-away exploded view of the drainage device shown in FIG. 6. FIG. 9 is a perspective view of a hose body and a drain connector of the drain hose according to an embodiment. FIG. 10 is a cut-away perspective view of a check valve of the drain hose according to an embodiment. FIG. 11 is a perspective view of a holder of the drain hose according to an embodiment. FIG. 12 is a cut-away perspective view of the holder of the drain hose shown in FIG. 11.

The dishwasher 1*a* may include the drainage device 400. The drainage device 400 may be provided to drain wash water inside the dishwasher 1*a*. The drainage device 400 may be provided to drain wash water inside the tub 12. The drainage device 400 may be provided to drain the wash water inside the water storage chamber 111. For example, the drainage device 400 may include the drain port 410 and the drain hose 420. The drainage device 400 may be referred to as a drain hose assembly 400, and a drain guide 400.

Referring to FIGS. 5 to 8, a direction in which the drain hose 420 is coupled to the drain port 410 is referred to as a first direction A, and a direction opposite to the first direction A may be referred to as the second direction B. The second direction B may refer to a direction in which wash water flows along the drain hose 420. Further, an axial direction may refer to a direction including the first direction A and the second direction B.

The drain hose 420 may be mounted to the drain port 410. The drain hose 420 may be detachably coupled to the drain port 410. The drain port 410 may be referred to as a drain hose connector 410.

It is illustrated that the drain port 410 is formed integrally with the sump housing 100 in the drawings, but is not limited thereto. The drain port 410 may be provided as a separate component from the sump housing 100.

For example, the drain port 410 may be provided as one component of the sump housing 100. The drain port 410 may be formed in the first sump body 110 of the sump housing 100. However, it is not limited thereto, and the drain port 410 may be provided as a separate component from the sump housing 100.

For example, the drain port 410 may be connected to the tub 12 to deliver wash water in the tub 12 to the drain hose 420. In this case, the drain port 410 may be directly connected to the tub 12 or indirectly connected to the tub 12 through a separate intermediate member.

The drain port 410 may be provided to communicate with the tub 12. For example, the drain port 410 may be provided to communicate with the water storage chamber 111. For example, the drain port 410 may be provided to communicate with the drain pump connector 142.

When the drain pump 600 performs a pumping operation, wash water and foreign substances remaining in the water storage chamber 111 may pass through the drain pump connector 142 and flow into the drain port 410. The wash water and foreign substances flowing into the drain port 410 may be discharged to the outside of the dishwasher 1*a* through the drain hose 420.

The drain port 410 may be disposed below the water storage chamber 111. Accordingly, the wash water and foreign substances remaining in the water storage chamber 111 may be smoothly introduced into the drain port 410 disposed below the water storage chamber 111. That is, a draining operation of the dishwasher 1*a* may be performed smoothly.

The drain port 410 may include a port body 411. The port body 411 may form an exterior of the drain port 410. For example, the port body 411 may have a substantially hollow cylindrical shape.

The port body 411 may be provided to allow wash water to flow. For example, the port body 411 may be provided to allow wash water, which is pumped by the drain pump 600, to flow. For example, the wash water of the tub 12 may be stored in the water storage chamber 111, and the wash water stored in the water storage chamber 111 may flow toward the port body 411.

The drain port 410 may include a locking portion 412. The locking portion 412 may be formed on an outer surface of the port body 411. For example, at least one locking portion 412 may be provided. Referring to FIGS. 6 and 7, two locking portions 412 are provided, but is not limited thereto. One or three or more of the locking portions 412 may be provided.

The drain port 410 may include a first inclined portion 413. For example, the first inclined portion 413 may be formed on the locking portion 412. The drain hose 420 may be easily coupled to the drain port 410 along the first inclined portion 413. The drain hose 420 may be smoothly coupled to the drain port 410 by the first inclined portion 413 of the locking portion 412. A detailed description thereof will be described later.

The drain port 410 may include a first guide portion 414. The first guide portion 414 may be provided to guide the coupling of a drain connector 422. The first guide portion 414 may be provided to guide insertion of the drain connector 422. That is, the first guide portion 414 may guide the movement of the drain connector 422 while the drain connector 422 is inserted into the port body 411. The first guide portion 414 may guide the movement of the drain connector 422 in a process in which the drain connector 422 is coupled to the port body 411.

In the state in which the drain connector 422 is coupled to the drain port 410, the first guide portion 414 may prevent the separation of the drain connector 422. For example, the first guide portion 414 may be provided to limit rotation of the drain connector 422 in a state in which the drain connector 422 is inserted into the port body 411. For example, the first guide portion 414 may function as a kind of stopper. Thus, the drain connector 422 may be stably coupled to the drain port 410, and the assembly stability of the drain hose 420 may be improved.

For example, the first guide portion 414 may extend along the axial direction of the drain hose 420. For example, the first guide portion 414 may include a protrusion 414*a* protruding toward the drain hose 420. The first guide portion 414 may be referred to as a first guide protrusion 414.

The drain hose 420 may be detachably coupled to the drain port 410. The drain hose 420 may be coupled to the drain port 410 in the first direction A. The drain hose 420 may be separated from the drain port 410 in the second direction A. The drain hose 420 may be provided to drain wash water, which is discharged from the drain port 410, to the outside. The drain hose 420 may be provided to guide wash water, which is discharged from the drain port 410, to the outside.

The drain hose 420 may include a hose body 421.

The hose body 421 may include a shape extending in the axial direction. For example, at least a portion of the hose body 421 may extend along the flow direction of the wash water. For example, the hose body 421 may include a corrugated pipe shape and may be provided to be bent as needed.

The hose body 421 may be provided to guide the wash water to the second direction B.

An one end 421*a* of the hose body 421 may be connected to the drain connector 422 to be described later. For example, the one end 421*a* of the hose body 421 may be integrally formed with the drain connector 422. The one end 421*a* of the hose body 421 may be insert-injected with an other end 422*b* of the drain connector 422. However, it is not limited thereto. Alternatively, the one end 421*a* of the hose body 421 may be detachably coupled to the other end 422*b* of the drain connector 422.

An other end 421*b* of the hose body 421 may be provided to communicate with the outside. The other end 421*b* of the hose body 421 may be provided to discharge wash water to the outside of the dishwasher 1*a* (or the home appliance 1). However, it is not limited thereto, and the other end 421*b* of the hose body 421 may be provided to discharge wash water into a water tank (not shown) provided inside the dishwasher 1*a* (or the home appliance 1).

The drain hose 420 may include the drain connector 422.

The drain connector 422 may be provided at the one end 421*a* of the hose body 421. The drain connector 422 may be connected to the one end 421*a* of the hose body 421. The other end 422*b* of the drain connector 422 may be provided to surround an outer circumferential surface of the one end 421*a* of the hose body 421. For example, the drain connector 422 may be integrally formed with the hose body 421. However, it is not limited thereto, and the drain connector 422 and the hose body 421 may be detachably coupled to each other.

The drain connector 422 may include a connector body 4221. The connector body 4221 may form an exterior of the drain connector 422. For example, the connector body 4221 may include an outer connector part 4221*a* coupled to an outer surface of the drain port 410 and an inner connector part 4221*b* coupled to an inner surface of the drain port 410. The drain connector 422 may be coupled to both of the outer surface of the drain port 410 and the inner surface of the drain port 410, and thus may be stably coupled to the drain port 410.

The drain connector 422 may include a locking hook 4222. The locking hook 4222 may be detachably coupled to the outer surface of the drain port 410. The locking hook 4222 may be provided to be locked to the locking portion 412 of the drain port 410. The locking hook 4222 may be provided as one component of the outer connector part 4221*a*.

The locking hook 4222 may be locked to the locking portion 412 of the drain port 410 as the drain connector 422 is inserted into the port body 411 of the drain port 410. The locking hook 4222 may be locked to the locking portion 412 as the drain connector 422 is inserted into the port body 411 in the first direction A. The locking hook 4222 may be locked to the locking portion 412 in response to the drain connector 422 being coupled to the port body 411 in the first direction A.

For example, referring to FIG. 9, the locking hook 4222 may include a hook body 4222*a*. The hook body 4222*a* may extend from the connector body 4221. The hook body 4222*a* may extend from the outer surface of the drain connector 422. The hook body 4222*a* may protrude toward the drain port 410.

For example, the locking hook 4222 may include a hooking protrusion 4222*b*. The hooking protrusion 4222*b* may be formed at one end of the hook body 4222*a*. The hooking protrusion 4222*b* may protrude toward the locking portion 412. The hooking protrusion 4222*b* may be locked to the locking portion 412. The hooking protrusion 4222*b* may be provided to be in contact with the locking portion 412. The hooking protrusion 4222*b* may be fastened to the locking portion 412. In a state in which the hooking protrusion 4222*b* is locked to the locking portion 412, the drain connector 422 may be prevented from being separated from the drain port 410.

The drain connector 422 may include a second inclined portion 4223. The locking hook 4222 may include the second inclined portion 4223. As the second inclined portion 4223 of the drain connector 422 is assembled along the first inclined portion 413 of the drain port 410, the drain hose 420 may be easily coupled to the drain port 410. For example, the second inclined portion 4223 may be provided to move along the first inclined portion 413. For example, the second inclined portion 4223 may be provided to move in the first direction A on the first inclined portion 413. For example, the second inclined portion 4223 may be slidable on the first inclined portion 413. For example, the locking hook 4222 may be opened as the second inclined portion 4223 slides on the first inclined portion 413. The locking hook 4222 may be retracted as the hooking protrusion 4222*b* is locked to the locking portion 412.

The drain connector 422 may include a second guide portion 4224. The second guide portion 4224 may be provided to correspond to the first guide portion 414 of the drain port 410. For example, the second guide portion 4224 may include a receiving groove 4224*a* provided to accommodate the protrusion 414*a* of the first guide portion 414. The second guide portion 4224 may be referred to as a second guide groove 4224.

However, it is not limited thereto, and the second guide portion 4224 may include a protrusion and the first guide portion 414 may include a receiving groove.

The first guide portion 414 of the drain port 410 and the second guide portion 4224 of the drain connector 422 may be provided to face downward. The first guide portion 414 may be disposed in the lower portion of the drain port 410. The second guide portion 4224 may be disposed in the lower portion of the drain connector 422. A worker can align the drain connector 422 with the drain port 410 in a proper direction by allowing the first guide portion 414 to correspond to the second guide portion 4224. Accordingly, the drain hose 420 may be accurately assembled to the drain port 410. However, it is not limited to the above example, and the first guide portion 414 of the drain port 410 and the second guide portion 4224 of the drain connector 422 may be provided to face upward.

The drain connector 422 may include a sealing member mounting portion 4225. The sealing member mounting portion 4225 may be provided at an one end 422*a* of the drain connector 422. A sealing member 425 to be described later may be detachably mounted to the sealing member mounting portion 4225. The sealing member 425 to be described later may be fitted to the sealing member mounting portion 4225. For example, the sealing member mounting portion 4225 may have a substantially cylindrical shape.

An undercut may not be formed in the sealing member mounting portion 4225. For example, the sealing member mounting portion 4225 may be formed to have a smooth shape. That is, the drain connector 422 may not be manufactured by a divided mold. Accordingly, a parting line may not be formed on the surface of the drain connector 422. That is, the drain connector 422 may be manufactured without a parting line. For example, the drain connector 422 may be manufactured in a forced extraction method. However, it is not limited thereto, and the drain connector 422 may be manufactured by various methods without a parting line.

Meanwhile, when manufacturing a component having an undercut shape, an expensive mold may be required, and a parting line may remain on a surface of the component. A step difference and/or a burr may be formed in the parting line, and wash water leakage may occur at a portion in which the step difference and/or burr are formed. However, according to the disclosure, because the parting line is not formed on the surface of the drain connector 422, it is possible to prevent leakage of wash water at the parting line.

The drain connector 422 may include a side portion 4226. The side portion 4226 may limit the second direction B-movement of the sealing member 425 coupled to the sealing member mounting portion 4225. The side portion 4226 may be provided to form a step difference with the sealing member mounting portion 4225. For example, the side portion 4226 may have a larger diameter than a diameter of the sealing member mounting portion 4225. Hereinafter the side portion 4226 may be referred to as a second side portion 4226. The side portion 4226 may be referred to as a second sidewall 4226.

The drain connector 422 may include a coupling protrusion 4227. The coupling protrusion 4227 may extend from the one end 422*a* of the drain connector 422. The coupling protrusion 4227 may protrude from the one end 422*a* of the drain connector 422 toward the drain port 410 in the first direction A. The coupling protrusion 4227 may extend from the one end 422*a* of the drain connector 422 toward a circumferential direction.

The coupling protrusion 4227 may be detachably coupled to a holder 424 to be described later. The coupling protrusion 4227 may be detachably coupled to a protrusion insertion portion 4243 of the holder 424.

For example, the coupling protrusion 4227 may be provided in plurality. At least one of the plurality of coupling protrusions 4227 may have a shape different from the rest of the plurality of coupling protrusions 4227. For example, the plurality of coupling protrusions may include a first coupling protrusion 4227*a* and a second coupling protrusion 4227*b*. A length of the first coupling protrusion 4227*a* in the circumferential direction may be greater than a length of the second coupling protrusion 4227*b* in the circumferential direction. The first coupling protrusion 4227*a* may correspond to a first protrusion insertion portion 4243*a* of the holder 424 to be described later. The second coupling protrusion 4227*b* may correspond to a second protrusion insertion portion 4243*b* of the holder 424 to be described later. Accordingly, the drain connector 422 and the holder 424 may be coupled in a properly aligned state.

The drain connector 422 may include a connector fixer 4228. The holder 424 to be described later may be fixed to the connector fixer 4228. The connector fixer 4228 may correspond to a holder fixer 4245 of the holder 424 to be described later. The connector fixer 4228 may be formed inside the drain connector 422. The connector fixer 4228 may be formed on the inner surface of the drain connector 422. For example, the connector fixer 4228 may include a shape recessed from the inner surface of the drain connector 422. The connector fixer 4228 may be referred to as a fixing groove 4228.

The drain hose 420 may include a check valve 423.

The check valve 423 may be provided to prevent a back flow of wash water. The check valve 423 may be provided to allow only the flow of wash water in the second direction B. The check valve 423 may be disposed inside the drain connector 422.

For example, the check valve 423 may be provided to include at least one of rubber or silicon. However, it is not limited thereto, and the check valve 423 may include various materials as long as the check valve 423 prevents the back flow of wash water.

The check valve 423 may include a valve body 4231.

The valve body 4231 may be detachably coupled to the drain connector 422. For example, the valve body 4231 may be coupled to the inner surface of the drain connector 422. The valve body 4231 may be detachably coupled to the holder 424. For example, the valve body 4231 may be coupled to an outer surface of the holder 424. For example, the valve body 4231 may have a substantially hollow cylindrical shape.

The check valve 423 may include a flap 4232.

The flap 4232 may be connected to at least a portion of the valve body 4231. The flap 4232 may be provided to open and close a drain flow path 422*c* formed inside the drain connector 422. The flap 4232 may open the drain flow path 422*c* to allow wash water to flow in the second direction B. For example, the flap 4232 may open and close the drain flow path 422*c* by pivoting with respect to the valve body 4231.

The check valve 423 may include a hinge 4233. The hinge 4233 may be provided to connect the valve body 4231 and the flap 4232. A part of an upper portion of the flap 4232 may be connected to the valve body 4231 through the hinge 4233. The flap 4232 may be provided to pivot with respect to the hinge 4233 in the valve body 4231.

The check valve 423 may include a first coupler 4236. The first coupler 4236 may have a shape corresponding to that of a second coupler 4246 of the holder 424 to be described later. That is, as the first coupler 4236 and the second coupler 4246 correspond to each other, the check valve 423 and the holder 424 may be accurately assembled. For example, the first coupler 4236 may include a groove shape.

For example, the first coupler 4236 may be provided on one side, which faces the holder 424, in the valve body 4231. The first coupler 4236 may be formed in the lower portion of the valve body 4231.

For example, the hinge 4233 may be formed in an upper portion of one side that is opposite to the one side of the valve body 4231. For example, when the first coupler 4236 is disposed to face downward, the hinge 4233 may be provided to face upward. For example, when the first coupler 4236 is disposed to face upward, the hinge 4233 may be provided to face downward.

Referring to FIG. 10, the check valve 423 may include a mounting portion 4234. The mounting portion 4234 may be provided to be in contact with an end of a first sealing extension portion 4244*a* of a second holder flange 4244 of the holder 424, which will be described later. The mounting portion 4234 may come into close contact with the end of the first sealing extension portion 4244*a*.

The check valve 423 may include a sealing inclined portion 4235. For example, the sealing inclined portion 4235 may obliquely extend from the mounting portion 4234. For example, the sealing inclined portion 4235 may extend from the mounting portion 4234 in the first direction A. The sealing inclined portion 4235 may be provided to correspond to the second holder flange 4244 of the holder 424 to be described later. The sealing inclined portion 4235 may be provided to be in contact with an outer surface of the first sealing extension portion 4244*a* of the second holder flange 4244 of the holder 424, which will be described later. The sealing inclined portion 4235 may come into close contact with the outer surface of the first sealing extension portion 4244*a*. The sealing inclined portion 4235 may have a shape in which a diameter decreases in the first direction A. The sealing inclined portion 4235 may have a shape corresponding to that of the first sealing extension portion 4244*a*.

For example, the holder 424 may be easily coupled to the check valve 423 by the sealing inclined portion 4235. For example, the second holder flange 4244 of the holder 424 may be coupled to the check valve 423 along the sealing inclined portion 4235. For example, when the check valve 423 and the holder 424 are completely coupled, the end of the first sealing extension portion 4244*a* may be seated on the mounting portion 4234. For example, when the check valve 423 and the holder 424 are completely coupled, the end of the first sealing extension portion 4244*a* may be in contact with the mounting portion 4234.

The check valve 423 may include a first sealing protrusion 4237. The first sealing protrusion 4237 may be provided to seal between the drain connector 422 and the valve body 4231. The first sealing protrusion 4237 may prevent leakage of wash water between the drain connector 422 and the valve body 4231. For example, the first sealing protrusion 4237 may protrude from an outer surface of the valve body 4231 to be in contact with the inner surface of the drain connector 422.

The check valve 423 may include a second sealing protrusion 4238. The second sealing protrusion 4238 may be provided to seal between the holder 424 and the valve body 4231. The second sealing protrusion 4238 may prevent leakage of wash water between the holder 424 and the valve body 4231. For example, the second sealing protrusion 4238 may protrude from an inner surface of the valve body 4231 to be in contact with an outer surface of the second holder flange 4244 of the holder 424.

The drain hose 420 may include the holder 424.

The holder 424 may be provided to fix the check valve 423 to the inside of the drain connector 422. The holder 424 may be detachably coupled to the one end 422*a* of the drain connector 422. A part of the holder 424 may be fixed to the inside of the drain connector 422.

The holder 424 may include a holder body 4241. The holder body 4241 may be disposed inside the drain connector 422. For example, the holder body 4241 may be a part coupled to the inner surface of the drain connector 422.

The holder 424 may include a first holder flange 4242 provided at one end of the holder body 4241. The first holder flange 4242 may be provided on a side, which faces the drain port 410, in the holder body 4241.

The first holder flange 4242 may extend from one end of the holder body 4241 to cover at least a portion of the one end 422*a* of the drain connector 422. For example, the first holder flange 424 may have a ring shape.

For example, the first holder flange 4242 may include a first extension portion 4242*a* and a second extension portion 4242*b*. The first extension portion 4242*a* may be provided to cover the one end 422*a* of the drain connector 422. The first extension portion 4242*a* may extend radially outward from the one end 422*a* of the holder body 4241. The second extension portion 4242*b* may extend from the first extension portion 4242*a* to cover the outer surface of the drain connector 422. The second extension portion 4242*b* may extend in the second direction B from the first extension portion 4242*a*.

Meanwhile, the second extension portion 4242*b* may limit movement of the sealing member 425 in the first direction A. For example, the second extension portion 4242*b* may prevent the sealing member 425, which is coupled to the sealing member mounting portion 4225, from being moved to the first direction A. For example, in a state in which the holder 424, the sealing member 425, and the drain connector 422 are coupled to each other, the second extension portion 4242*b* may prevent the sealing member 425 from being moved to the first direction A. For example, the second extension portion 4242*b* may have a larger diameter than the diameter of the sealing member mounting portion 4225. Hereinafter the second extension portion 4242*b* may be referred to as a first side portion 4242*b*. The second extension portion 4242*b* may be referred to as a first sidewall 4242*b*.

The holder 424 may include the protrusion insertion portion 4243. The protrusion insertion portion 4243 may be detachably coupled to the coupling protrusion 4227 of the drain connector 422. The coupling protrusion 4227 of the drain connector 422 may be inserted into the protrusion insertion portion 4243. For example, in a state in which the holder 424 and the check valve 423 are coupled, the protrusion insertion portion 4243 of the holder 424 may be coupled to the coupling protrusion 4227 of the drain connector 422. Thus, the holder 424 may more stably fix the check valve 423 to the drain connector 422.

The protrusion insertion portion 4243 may be provided to correspond to the coupling protrusion 4227 of the drain connector 422. For example, the protrusion insertion portion 4243 may be formed on the first extension portion 4242*a*. The protrusion insertion portion 4243 may have a shape recessed in the first direction A. For example, the protrusion insertion portion 4243 may be formed to penetrate the first extension portion 4242*a*. That is, the protrusion insertion portion 4243 may be formed as a hole. However, the disclosure is not limited thereto, and it is sufficient that the protrusion insertion portion 4243 has a shape into which the coupling protrusion 4227 of the drain connector 422 is inserted. For example, the protrusion insertion portion 4243 may be formed as a groove.

For example, the protrusion insertion portion 4243 may be provided in plurality. At least one of the plurality of protrusion insertion portions 4243 may have a shape different from the rest of the plurality of protrusion insertion portions 4243. For example, the plurality of protrusion insertion portions 4243 may include the first protrusion insertion portion 4243*a* and the second protrusion insertion portion 4243*b*. The first protrusion insertion portion 4243*a* may correspond to the first coupling protrusion 4227*a*. The second protrusion insertion portion 4243*b* may correspond to the second coupling protrusion 4227*b*. Accordingly, a worker can correctly recognize the assembly direction of the drain connector 422 and the holder 424 by matching the plurality of protrusion insertion portions 4243 with the plurality of coupling protrusions 4227. As a result, the drain connector 422 and the holder 424 may be coupled in a properly aligned state, and the assemblability of the drain hose 420 may be improved.

The holder 424 may include the second holder flange 4244 provided at the other end of the holder body 4241. The second holder flange 4244 may be provided on a side, which faces the drain connector 422, in the holder body 4241. The second holder flange 4244 may be provided on a side, which faces the check valve 423, in the holder body 4241.

The second holder flange 4244 may be provided to seal between the check valve 423 and the holder 424. The second holder flange 4244 may be provided in close contact with the check valve 423.

For example, referring to FIG. 12, the second holder flange 4244 may include the first sealing extension portion 4244*a* and the second sealing extension portion 4244*b*.

The first sealing extension portion 4244*a* may be provided to come into close contact with the valve body 4231 of the check valve 423. The first sealing extension portion 4244*a* may have a shape corresponding to the sealing inclined portion 4235 of the check valve 423. The first sealing extension portion 4244*a* may have a shape in which a diameter decreases in the first direction A. That is, the first sealing extension portion 4244*a* may include an inclined region. In this case, the inclined region may represent a region between one side of the first sealing extension portion 4244*a* having a first diameter d1 and the other side of the first sealing extension portion 4244*a* having a second diameter d2.

For example, an inclination of the inclined region of the first sealing extension portion 4244*a* may be provided to be not great. Accordingly, the second holder flange 4244 of the holder 424 may be manufactured in a forced extraction method, and a parting line may not remain on the surface of the holder 424.

For example, one side of the first sealing extension portion 4244*a* may have the first diameter d1. The other side of the first sealing extension portion 4244*a* may have the second diameter d2 greater than the first diameter d1. The other side of the first sealing extension portion 4244*a* may be an end of the first sealing extension portion 4244*a*.

The second sealing extension portion 4244*b* may be provided to come into close contact with the flap 4232 of the check valve 423. An end of the second sealing extension portion 4244*b* may have a third diameter d3. For example, the third diameter d3 may be less than the first diameter d1. The third diameter d3 may be less than the second diameter d2.

The second holder flange 4244 may include a groove portion 4244*c* recessed between the first sealing extension portion 4244*a* and the second sealing extension portion 4244*b*. For example, the groove portion 4244*c* may have a shape recessed in the first direction A. The groove portion 4244*c* may have a shape extending along the circumferential direction of the holder 424. The groove portion 4244*c* may have a fourth diameter d4. For example, the fourth diameter d4 may be less than the first diameter d1. The fourth diameter d4 may be less than the second diameter d2. The fourth diameter d4 may be greater than the third diameter d3.

The above-described second holder flange 4244 includes the first sealing extension portion 4244*a*, the second sealing extension portion 4244*b*, and the groove portion 4244*c*, and thus the second holder flange 4244 may be in close contact with the check valve 423. That is, the sealing force of the second holder flange 4244 may be improved.

The holder 424 may include the holder fixer 4245. The holder fixer 4245 may be fixed to the connector fixer 4228.

The holder fixer 4245 may correspond to the connector fixer 4228. For example, the holder fixer 4245 may be formed on the outer surface of the holder body 4241. The holder fixer 4245 may include a shape protruding from the outer surface of the holder body 421. The holder fixer 4245 may be referred to as a fixing protrusion 4245.

For example, the holder fixer 4245 may be formed as a groove and the connector fixer 4228 may be formed as a protrusion, which is opposite to what is shown in the drawings.

The holder 424 may include the second coupler 4246. The second coupler 4246 may have a shape corresponding to that of the first coupler 4236 of the check valve 423. That is, as the first coupler 4236 and the second coupler 4246 correspond to each other, the check valve 423 and the holder 424 may be accurately assembled. For example, the second coupler 4246 may include a protruding shape.

For example, the second coupler 4246 may be provided on one side, which faces the check valve 423, in the holder body 4241. The second coupler 4246 may be formed in the lower portion of the holder body 4241 to correspond to the first coupler 4236.

For example, the first coupler 4236 may be formed as a protrusion and the second coupler 4246 may be formed as a groove, which is opposite to what is shown in the drawings.

The drain hose 420 may include the sealing member 425. The sealing member 425 may be provided to prevent leakage of wash water between the drain hose 420 and the drain port 410. For example, the sealing member 425 may have a ring shape. For example, the sealing member 425 may include at least one of rubber and silicon. However, it is not limited thereto, and the sealing member 425 may be formed of various shapes and/or materials.

The sealing member 425 may be mounted on the drain connector 422. The sealing member 425 may be detachably coupled to the sealing member mounting portion 4225 of the drain connector 422. The sealing member 425 may be provided to be inserted into the sealing member mounting portion 4225 of the drain connector 422.

Figure 13:
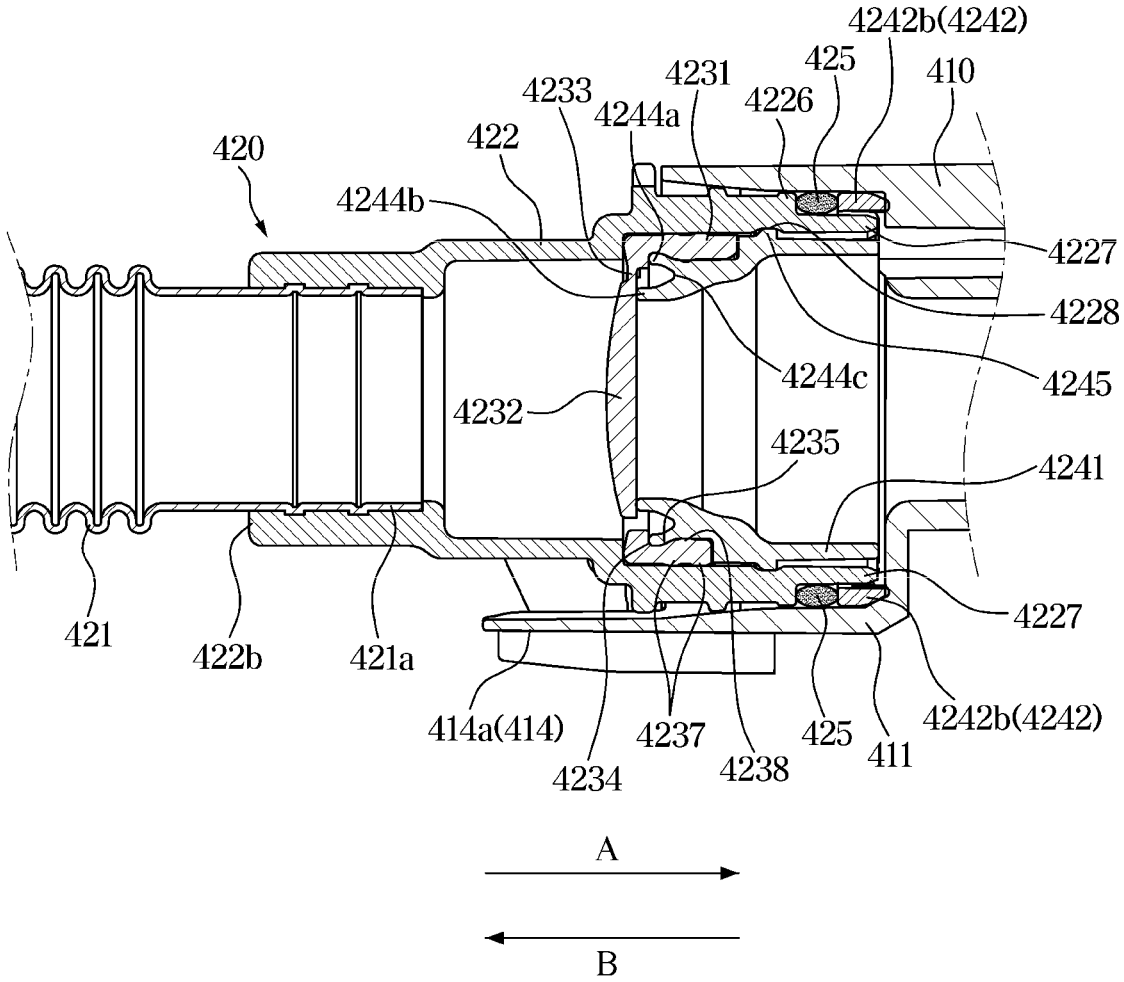
FIG. 13 is a schematic side cross-sectional view of the drainage device according to an embodiment.
Figure 14:
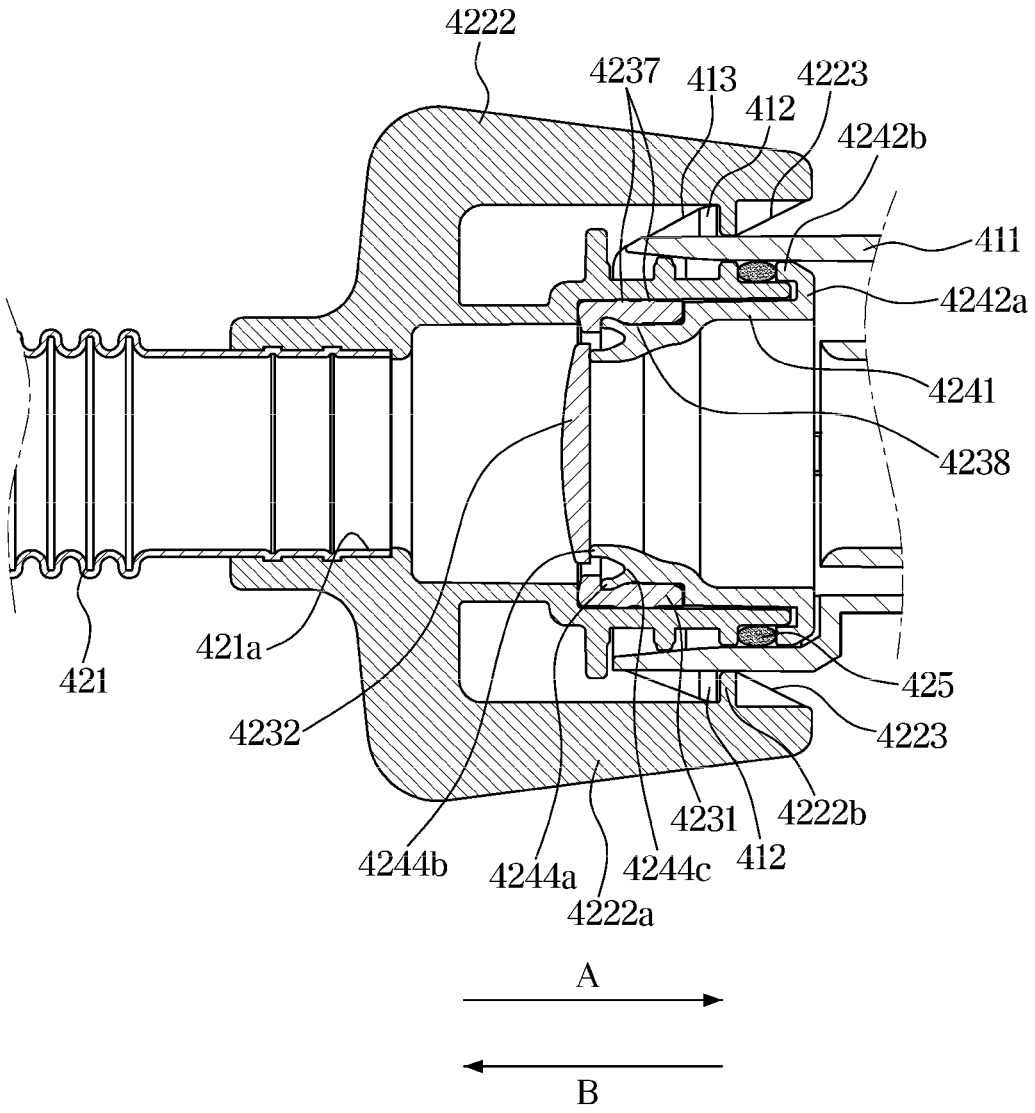
FIG. 14 is a schematic top cross-sectional view of the drainage device according to an embodiment.

FIG. 13 is a schematic side cross-sectional view of the drainage device according to an embodiment. FIG. 14 is a schematic top cross-sectional view of the drainage device according to an embodiment.

Referring to FIGS. 13 and 14, the drain hose 420 may be coupled to the drain port 410. The drain hose 420 may be inserted into drain port 410.

At least a part of the connector body 4221 of the drain connector 422 may be disposed outside the drain port 410. The outer connector part 4221*a* of the connector body 4221 may be coupled to the outer surface of the drain port 410.

At least a part of the connector body 4221 of the drain connector 422 may be disposed inside the drain port 410. The inner connector part 4221*b* of the connector body 4221 may be coupled to the inner surface of the drain port 410.

The check valve 423 and the holder 424 may be disposed inside the drain connector 422. The holder 424 may fix the check valve 423 to the inside of the drain connector 422.

The valve body 4231 of the check valve 423 may be provided to laterally seal the drain connector 422. Accordingly, the flap 4232 may be provided not to be affected by the sealing force of the valve body 4231. For example, the first sealing protrusion 4237 may be provided to seal the inner surface of the drain connector 422 with respect to the radial direction of the valve body 4231.

The valve body 4231 of the check valve 423 may be provided to laterally seal the second holder flange 4244 of the holder 424. Accordingly, the flap 4232 may be provided not to be affected by the sealing force of the valve body 4231. For example, the second sealing protrusion 4238 may be provided to seal an outer surface of the second holder flange 4244 with respect to the radial direction of the valve body 4231.

The holder body 4241 of the holder 424 may be coupled to the inner surface of the drain connector 424. The holder fixer 4245 of the holder 424 may be provided to be fastened to the connector fixer 4228 of the drain connector 424.

The first holder flange 4242 of the holder 424 may be provided to cover the one end 422*a* of the drain connector 422. The first holder flange 4242 of the holder 424 may be provided to laterally hold the one end 422*a* of the drain connector 422. The first holder flange 4242 of the holder 424 may be provided to hold the one end 422*a* of the drain connector 422 in the radial direction of the drain connector 422. The coupling protrusion 4227 of the drain connector 424 may be inserted into the protrusion insertion portion 4243 of the first holder flange 4242. As a result, the drain connector 422 and the holder 424 may be more firmly coupled.

The second holder flange 4244 of the holder 424 may be provided in close contact with the check valve 423. When the holder 424 and the check valve 423 are completely coupled, an end of the first sealing extension portion 4244*a* may come into contact with the mounting portion 4234. In a state in which the holder 424 and the check valve 423 are completely coupled, an end of the second sealing extension portion 4244*b* may come into contact with the flap 4232.

The sealing member 425 may be coupled to the outer surface of the drain connector 422. The movement of the sealing member 425 in the first direction A may be limited by the first side portion 4242*b* of the holder 424. The movement of the sealing member 425 in the second direction B may be limited by the second side portion 4226 of the holder 424. The sealing member 425 may be provided to be surrounded by the inner surface of the drain port 410, the outer surface of the drain connector 422, the first side portion 4242*b*, and the second side portion 4226. Therefore, the sealing member 425 may not be damaged even by an external impact or internal water pressure. Further, the separation of the sealing member 425 may be prevented.

Figure 15:
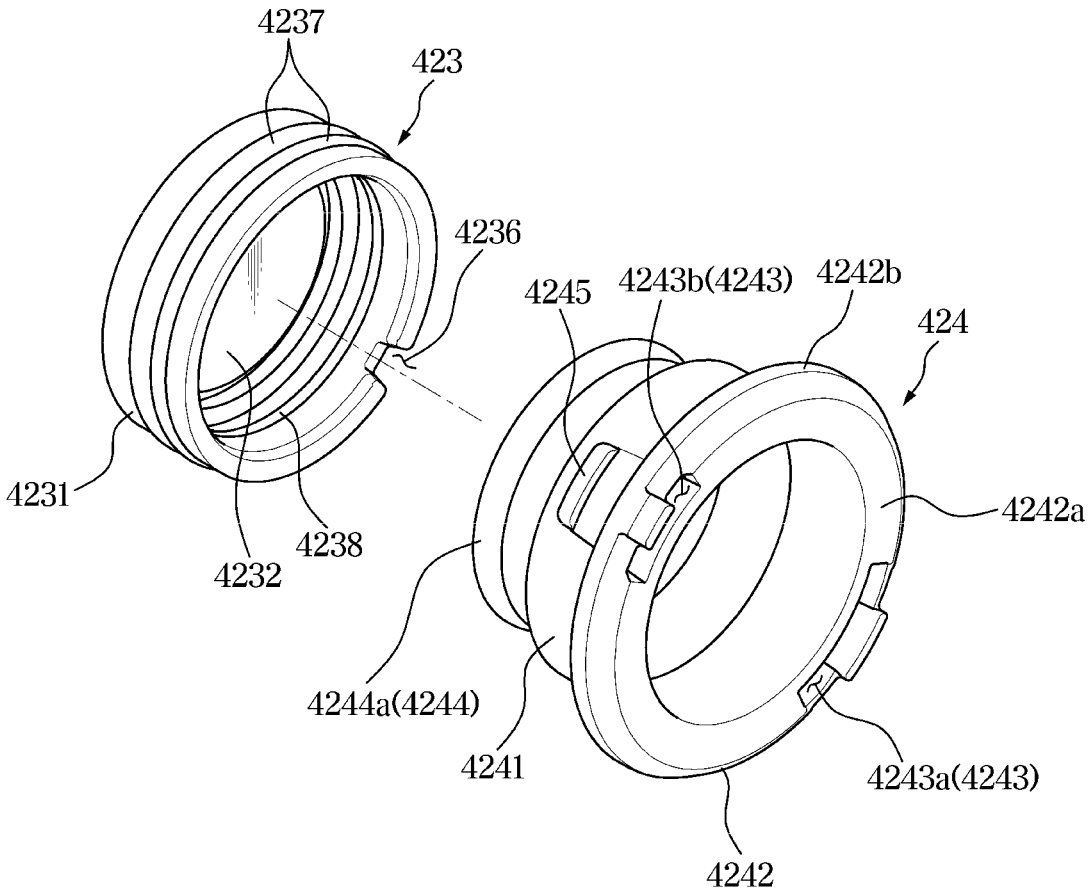
FIG. 15 is a view illustrating a state in which the check valve and the holder are aligned according to an embodiment.
Figure 16:
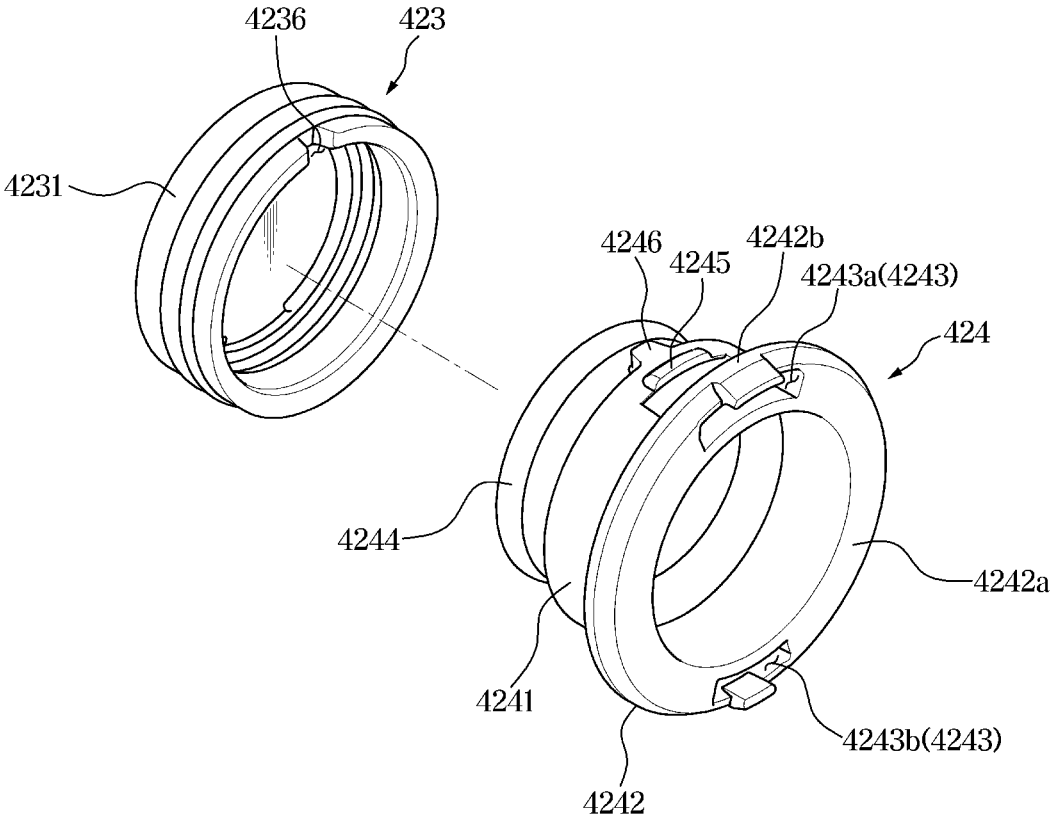
FIG. 16 is a view illustrating the check valve and holder shown in FIG. 15 when viewed from another direction.
Figure 17:
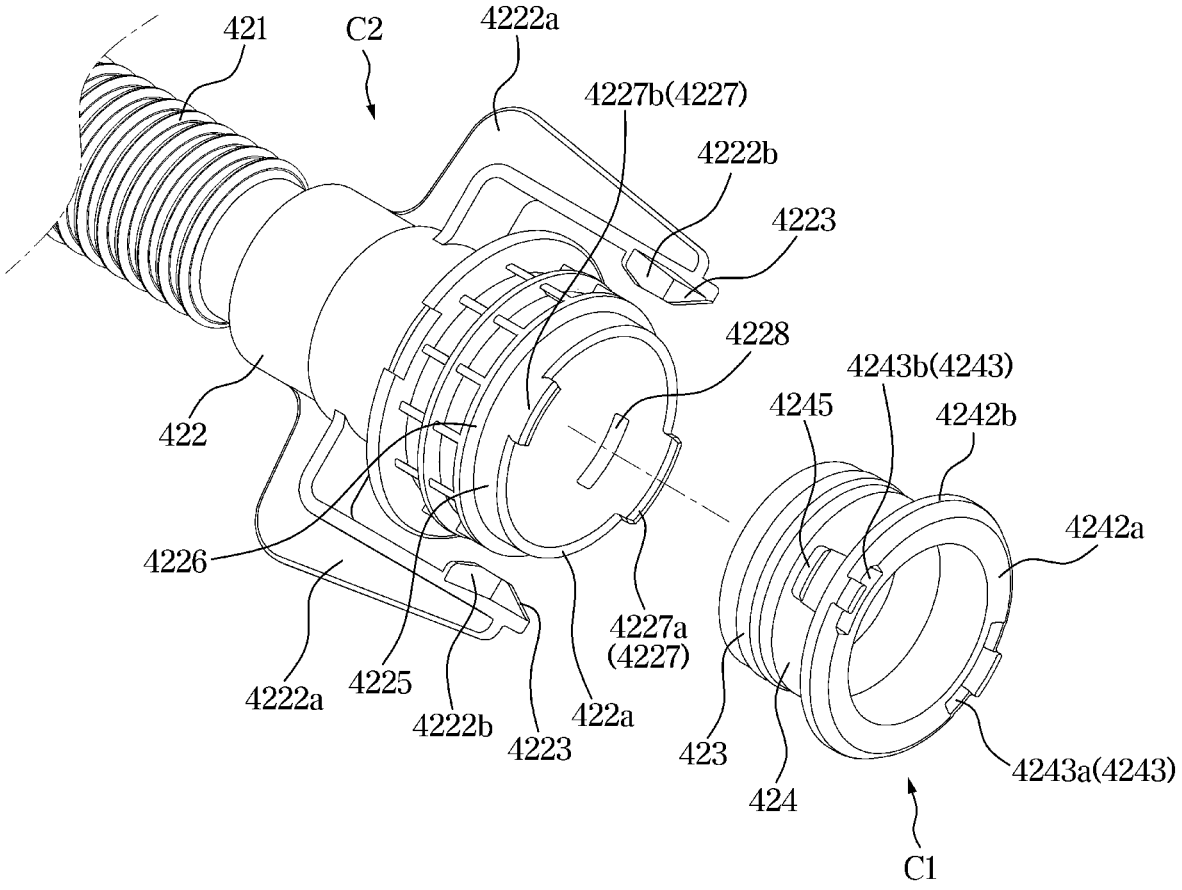
FIG. 17 is a view illustrating a state in which an assembly of the check valve and the holder shown in FIG. 16 is aligned with an assembly of the hose body and the drain connector.
Figure 18:
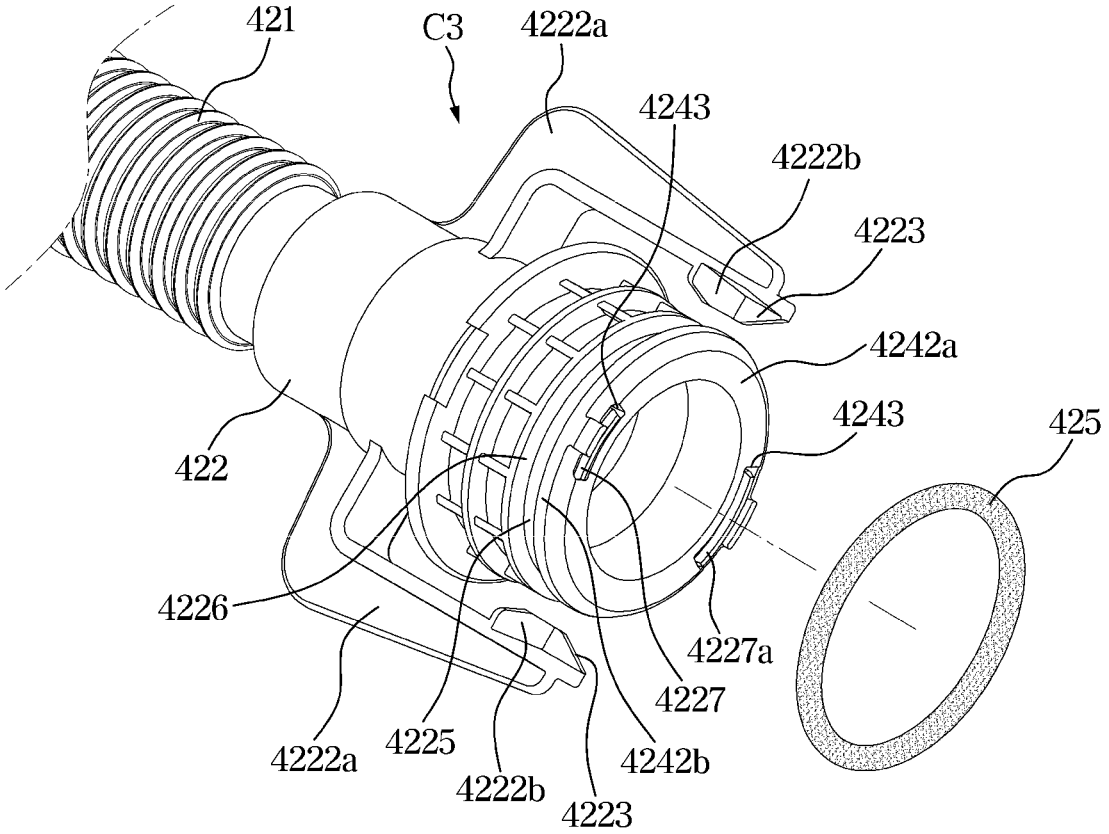
FIG. 18 is a view illustrating a state in which a sealing member according to an embodiment is aligned with the assembly of the hose body, the drain connector, the check valve and the holder shown in FIG. 17.

FIG. 15 is a view illustrating a state in which the check valve and the holder are aligned according to an embodiment. FIG. 16 is a view illustrating the check valve and holder shown in FIG. 15 when viewed from another direction. FIG. 17 is a view illustrating a state in which an assembly of the check valve and the holder shown in FIG. 16 is aligned with an assembly of the hose body and the drain connector. FIG. 18 is a view illustrating a state in which a sealing member according to an embodiment is aligned with the assembly of the hose body, the drain connector, the check valve and the holder shown in FIG. 17.

Referring to FIGS. 15 and 16, the check valve 423 and the holder 424 may be aligned in the axial direction. For example, the first coupler 4236 of the check valve 423 and the second coupler 4246 of the holder 424 may be provided to correspond to each other. As the first coupler 4236 and the second coupler 4246 correspond to each other, the first coupler 4236 and the second coupler 4246 may be accurately coupled. The first coupler 4236 and the second coupler 4246 may be detachably coupled in the axial direction.

In general, when the hinge faces downward, the shape of the check valve may be deformed by gravity or the like. For example, a portion of the flap, which is not connected to the valve body through the hinge, may be provided to face upward and bent by gravity. Accordingly, it is appropriate that the hinge is positioned to face upward.

For example, the first coupler 4236 and the hinge 4233 of the check valve 423 may be positioned opposite to each other. After a work assembles the check valve 423 and the holder 424, the work can allow the coupling portion between the first coupler 4236 and the second coupler 4246 to face downward, thereby placing the hinge 4233 to face upward. That is, the position of the hinge 4233 may be accurately identified through the first coupler 4236 and the second coupler 4246. For example, the hinge 4233 may be disposed to face upward so as to be minimally affected by gravity. Thus, the assembly of the check valve 423 and the holder 424 may be accurately coupled to the drain connector 422. As a result, the assemblability of the drain hose 420 may be improved.

Referring to FIG. 17, an assembly C1 of the check valve 423 and the holder 424 and an assembly C2 of the hose body 421 and the drain connector 422 may be axially aligned. The assembly C1 may be referred to as a first assembly C1. The assembly C2 may be referred to as a second assembly C2.

The holder fixer 4245 of the holder 424 may be fixed to the connector fixer 4228 of the drain connector 422. The coupling protrusion 4227 of the drain connector 422 may be coupled to the protrusion insertion portion 4243 of the holder 424. For example, as the first protrusion insertion portion 4243*a* corresponds to the first coupling protrusion 4227*a* and as the second protrusion insertion portion 4243*b* corresponds to the second coupling protrusion 4227*b*, the first assembly C1 and the second assembly C2 may be accurately coupled. The first assembly C1 and the second assembly C2 may be detachably coupled in the axial direction.

Referring to FIG. 18, an assembly C3 of the hose body 421, the drain connector 422, the check valve 423 and the holder 424, and the sealing member 425 may be aligned in the axial direction. The assembly C3 may be referred to as a third assembly C3. The sealing member 425 may be mounted on the sealing member mounting portion 4225 of the drain connector 422. The first side portion 4242*b* of the holder 424 may be provided on one side of the sealing member mounting portion 4225, and the second side portion 4226 of the holder 424 may be provided on the other side of the sealing member 425. The first side portion 4242*b* and the second side portion 4226 may prevent the sealing member 425 from being easily separated from the sealing member mounting portion 4225.

Figure 19:
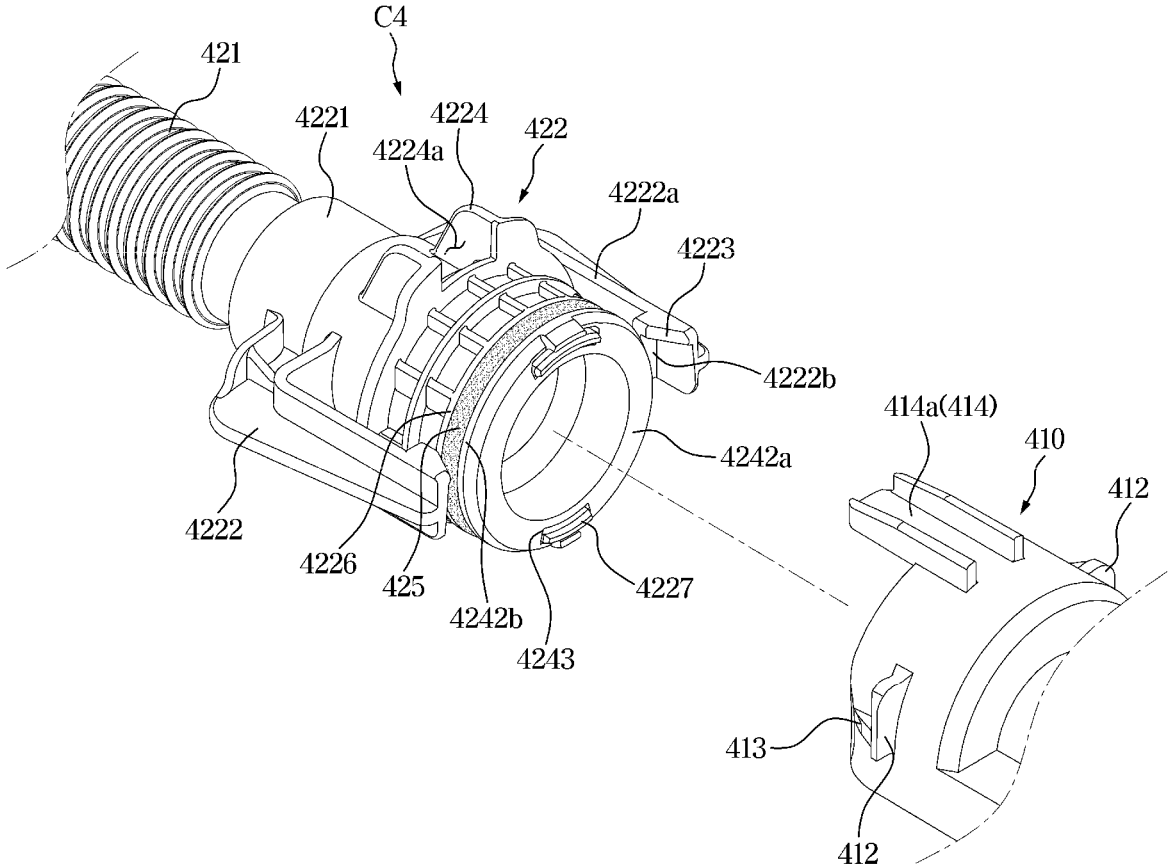
FIG. 19 is a view illustrating a state in which the drain hose is aligned with the drain port according to an embodiment.

Referring to FIG. 19, an assembly C4 of the hose body 421, the drain connector 422, the check valve 423, the holder 424, and the sealing member 425 may be axially aligned relative to the drain port 410. The assembly C4 may be referred to as the drain hose 420. The first guide portion 414 of the drain port 410 and the second guide portion 4224 of the drain hose 420 may correspond to each other. Accordingly, as the coupling direction of the drain port 410 and the drain hose 420 is set, the drain port 410 and may be more easily coupled to the drain hose 420.

When the drain hose 420 is assembled to the drain port 410, the sealing member 425 may be protected by the first holder flange 4242 of the holder 424. For example, when the drain hose 420 is assembled to the drain port 410, the first holder flange 424 may be in contact with the drain port 410 before the sealing member 425. Accordingly, in the process of coupling the drain hose 420 to the drain port 410, it is possible to prevent the sealing member 425 from being misassembled with the drain port 410 due to friction with the inner surface of the drain port 410 or it is possible to prevent the sealing member 425 from being separated from the sealing member mounting portion 4225.

Referring to FIGS. 15 to 19, the drain connector 422, the check valve 423, and the holder 424 may be detachably assembled from each other.

For example, when components of the drain hose are integrally formed, it may be difficult to check the assembled state of the drain hose. In addition, when a difficulty occurs in some of the integrated components, it is required to replace the entire components, and it is required to discard other components having no difficulty. In addition, when insert injection is performed to integrally form components of the drain hose, the manufacturing process may be complicated and the cost may increase.

However, components of the drain hose 420 may not be integrally formed. For example, the drain connector 422, the check valve 423, and the holder 424 may not be integrally formed. For example, the drain connector 422, the check valve 423, and the holder 424 may not be insert injected. Accordingly, it is possible to reduce the time and cost required in the insert injection process. In addition, the assembled state of the drain connector 422, the check valve 423, and the holder 424 may be easily checked with the naked eye. In addition, even when there is a difficulty with some of the components of the drain connector 422, the check valve 423, and the holder 424, only some of the components may be replaced, and other components without difficulties may be recycled.

Figure 20:
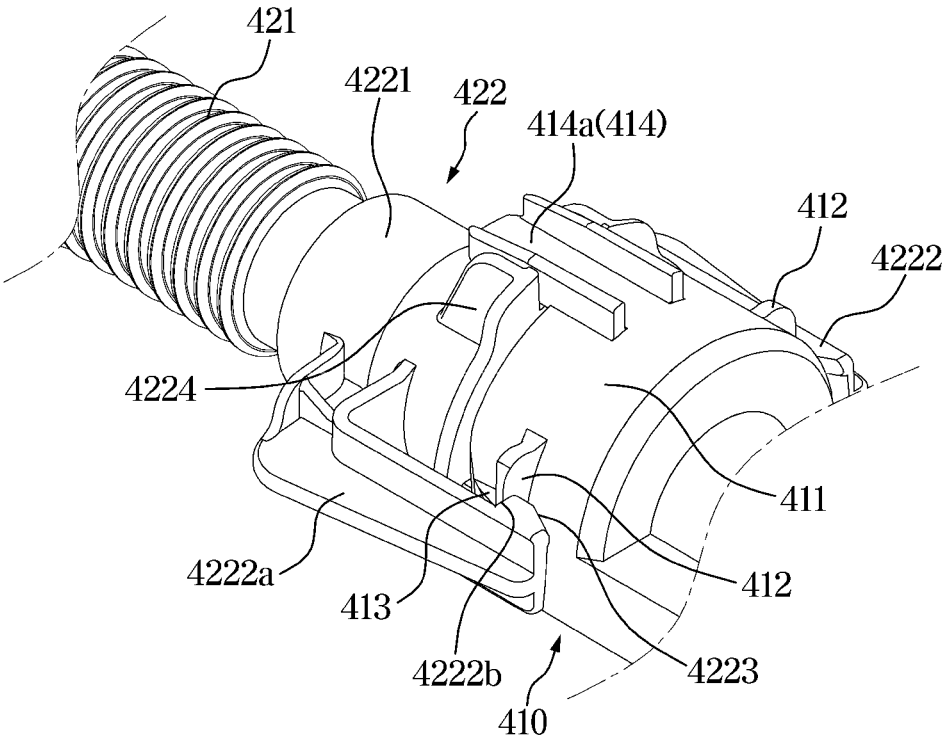
FIG. 20 is a view illustrating a state in which the drain hose shown in FIG. 19 is coupled to the drain port.

Referring to FIG. 20, the drain hose 420 may be coupled to the drain port 410.

The drain hose 420 may be inserted into the drain port 410 in the first direction A. The drain connector 422 may be inserted into the port body 411 in the first direction A. Accordingly, the locking hook 4222 of the drain connector 422 may be provided to be locked to the locking portion 412 of the drain port 410.

For example, in the process of coupling the drain hose 420 to the drain port 410, the second inclined portion 4223 of the drain connector 422 may be moved toward the first direction A along the first inclined portion 413 of the drain port 410. The second inclined portion 4223 may be provided to slide on the first inclined portion 413. After the second inclined portion 4223 is moved along the first inclined portion 413, the hooking protrusion 4222*b* may be provided to be locked to the locking portion 412. As the hooking protrusion 4222*b* is locked to the locking portion 412, the drain hose 420 may not be separated from the drain port 410 in the second direction B. That is, the drain hose 420 may not be easily separated from the drain port 410. In addition, the drain hose 420 may be easily coupled to the drain port 410 without a separate fixing member.

For example, the drain hose 420 may be coupled to the drain port 410 without a separate clamp. Accordingly, it is possible to prevent quality issues such as the mis-assembly due to the use of the clamp. Further, a large space for clamping may not be required. In addition, it is possible to reduce the time and cost required for installing a clamp.

For example, the drain hose 420 may not be fixed to other components by a separate support bracket or the like. As a result, vibration of the drain pump 600 may not be transmitted to an object to which the drain hose 420 is fixed.

Figure 21:
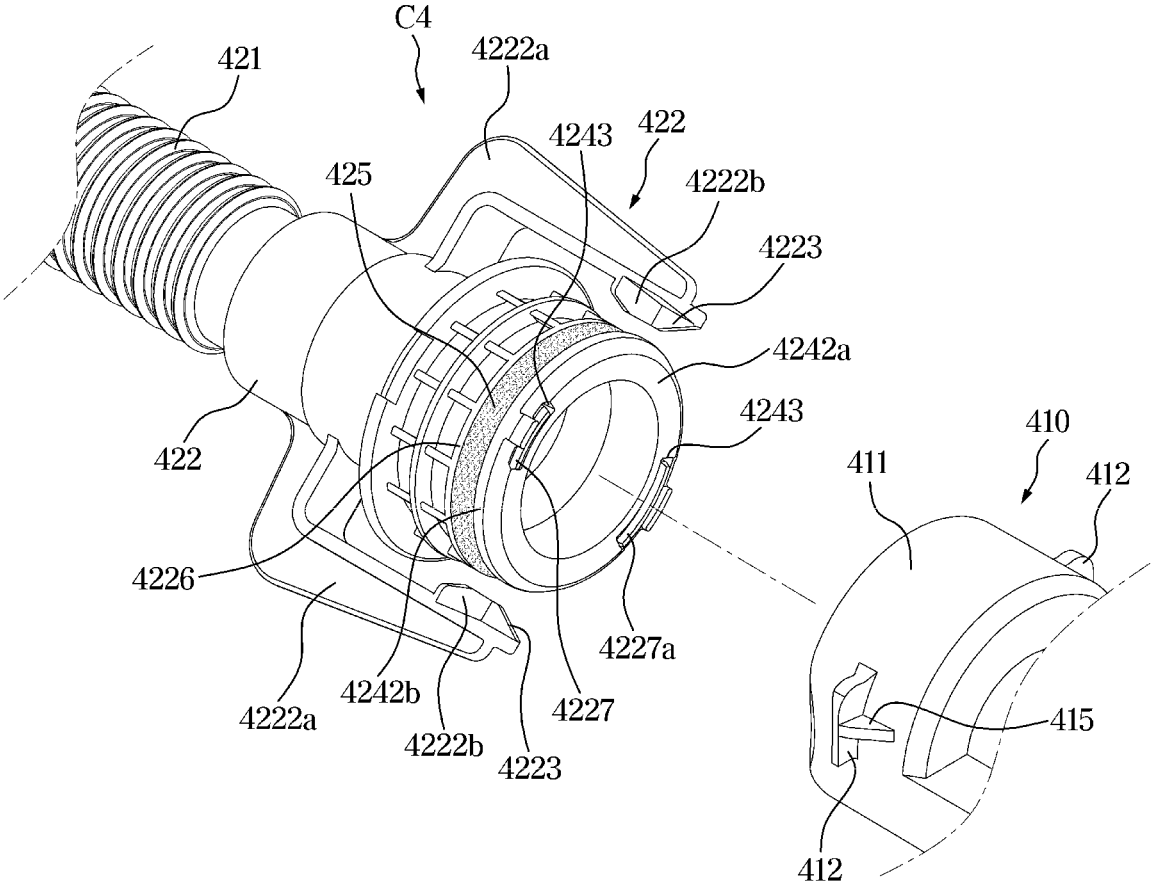
FIG. 21 is a view illustrating a state in which the drain hose is aligned with the drain port according to an embodiment.
Figure 22:
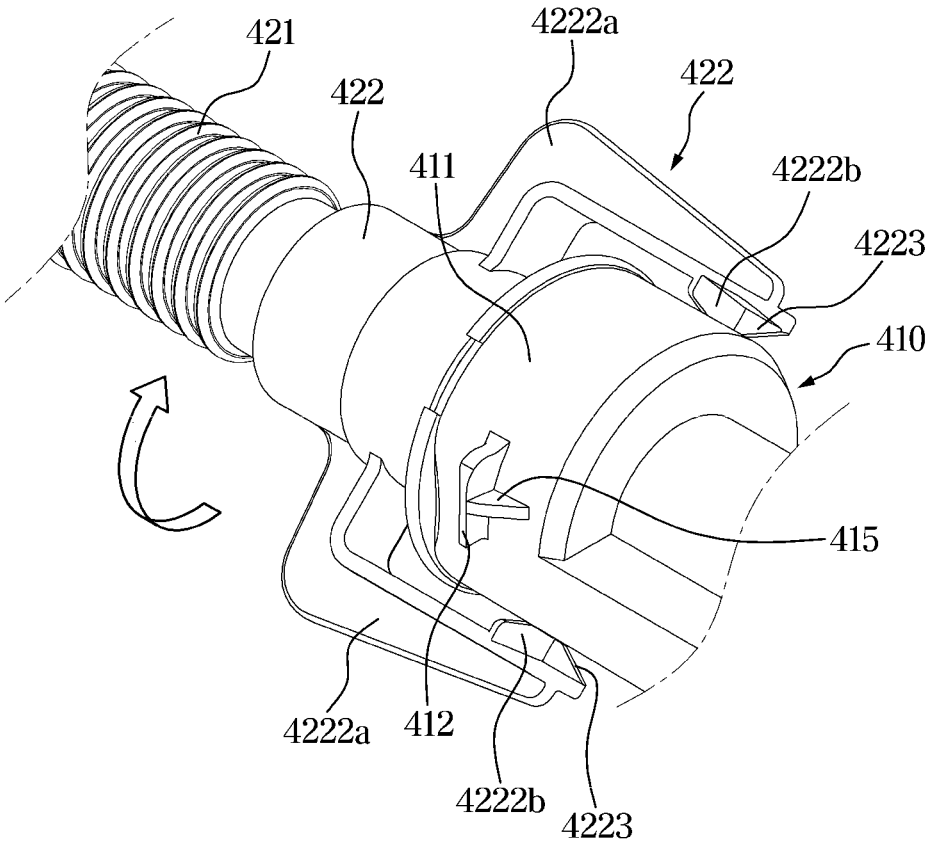
FIG. 22 is a view illustrating a state in which the drain hose shown in FIG. 21 is inserted into the drain port.

FIG. 21 is a view illustrating a state in which the drain hose is aligned with the drain port according to an embodiment. FIG. 22 is a view illustrating a state in which the drain hose shown in FIG. 21 is inserted into the drain port. FIG.

23 is a view illustrating a state in which the drain hose shown in FIG. 22 is rotated in one direction and coupled to the drain port.

Figure 23:
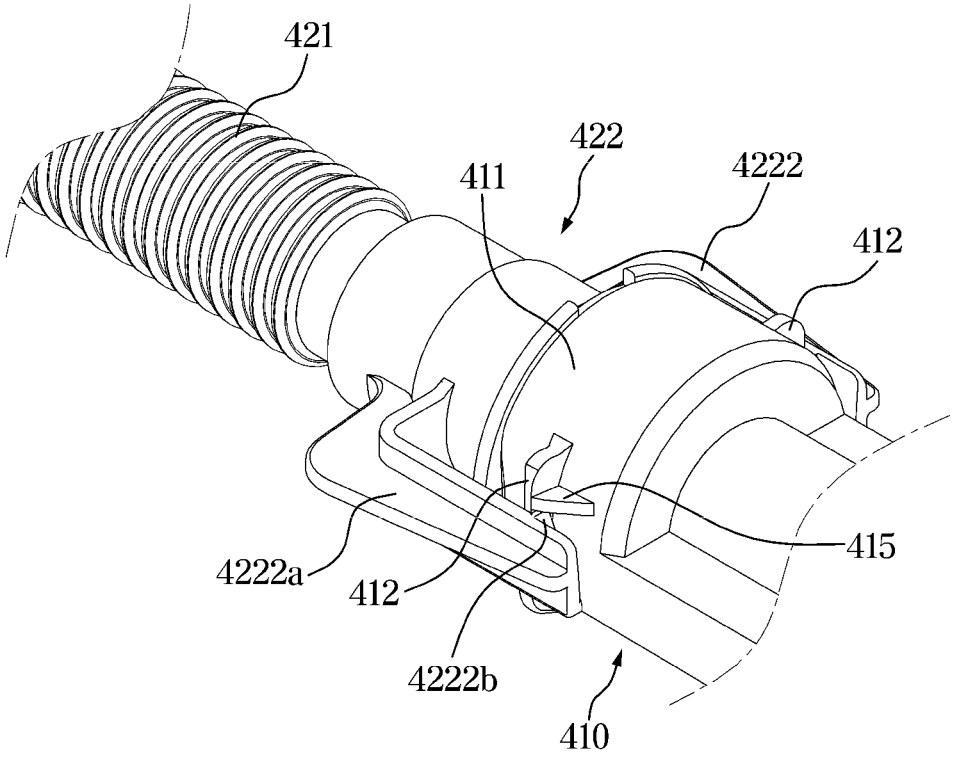
FIG. 23 is a view illustrating a state in which the drain hose shown in FIG. 22 is rotated in one direction and coupled to the drain port.
Figure 24:
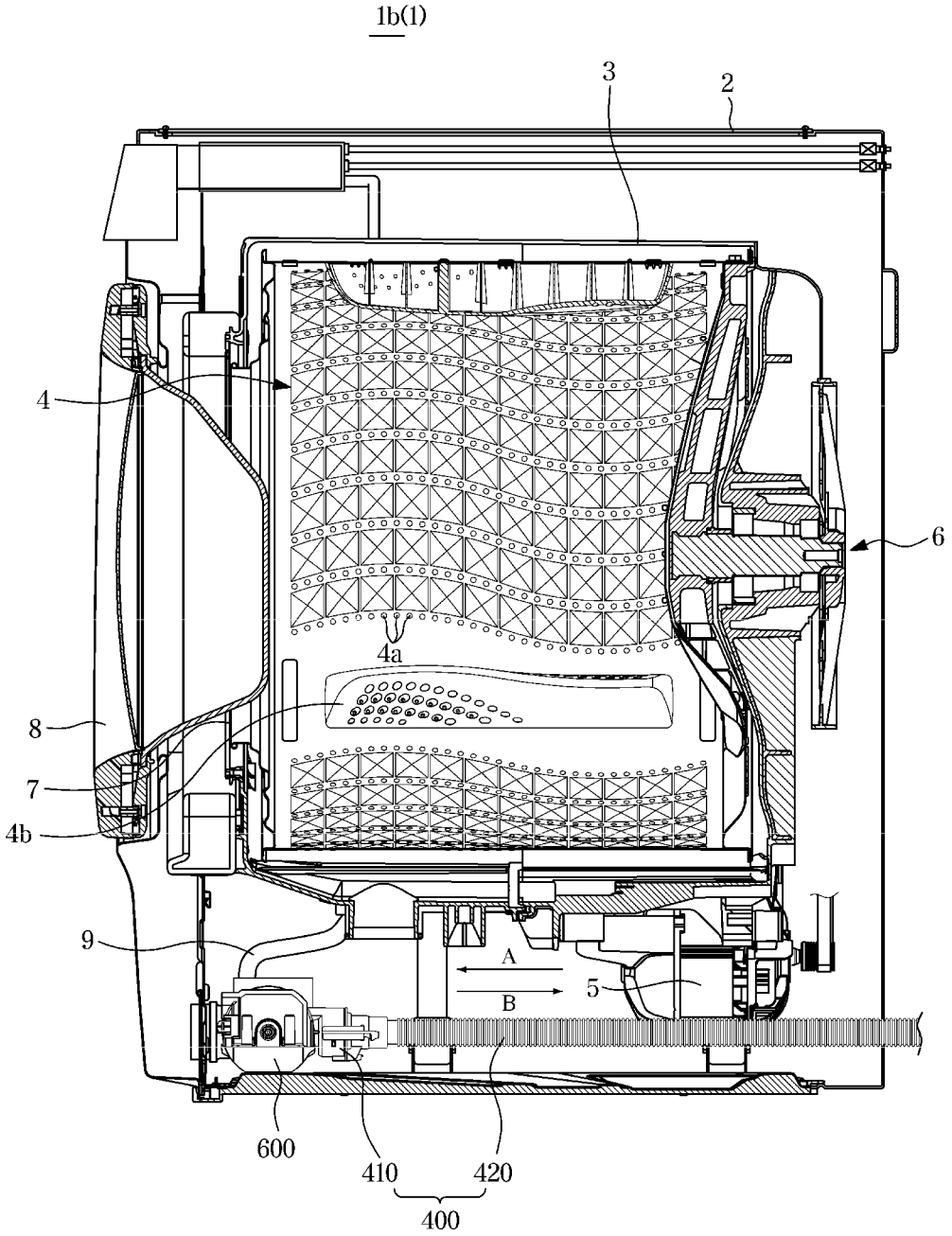
FIG. 24 is a schematic side cross-sectional view of a washing machine according to an embodiment.

Referring to FIGS. 21 to 23, the drain hose 420 may be rotatably coupled to the drain port 410.

For example, the drain hose 420 may be inserted into the drain port 410 and rotated. As the drain hose 420 is rotated with respect to the drain port 410, the drain connector 422 may be coupled to the port body 411 of the drain port 410. The locking hook 4222 of the drain connector 422 may be provided to be locked to the locking portion 412 of the drain port 410. Accordingly, the drain hose 420 may be fixed to the drain port 410 and may not be separated from the drain port 410.

Meanwhile, a stopper 415 may be provided in at least one of the drain hose 420 and the drain port 410. The stopper 415 may be provided to limit rotation of the drain hose 420. Accordingly, the stopper 415 may set the rotation range of the drain hose 420 so as to allow the drain hose 420 to be accurately assembled to the drain port 410. It is illustrated that the stopper 415 is formed in the drain port 410 in the drawings, but this is merely exemplary. The shape and/or location of the stopper 415 may vary as long as the stopper 415 limits rotation of the drain hose 420.

FIG. 24 is a schematic side cross-sectional view of a washing machine according to an embodiment.

In FIG. 24, a front-loading washing machine 1*b* including an input port formed at the front is illustrated as an example, but is not limited thereto. For example, the washing machine 1*b* may be a top-loading washing machine including an input port formed thereon, and the type of washing machine is not limited thereto. A drainage assembly according to the disclosure may be applied to various types of washing machines.

Referring to FIG. 24, the washing machine 1*b* may include a cabinet 2 forming an exterior, a tub 3 disposed inside the cabinet 2, a drum 4 rotatably disposed inside the tub 3, and a drive motor 5 configured to drive the drum 4. Meanwhile, the cabinet 2 may be referred to as a main body 2.

An input port 7 may be formed at the front of the cabinet 2 to input laundry into the drum 4. The input port 7 may be opened and closed by a door 8 installed in the front of the cabinet 2.

The drum 4 may include a plurality of through holes 4*a* for distributing wash water. The drum 4 may include a plurality of lifters 4*b* to allow laundry to be raised and dropped while rotating.

The drum 4 and the drive motor 5 may be connected through a connector 6. The connector 6 may be provided to transfer the driving force generated by the drive motor 5 to the drum 4. For example, the connector 6 may include a shaft, a pulley, a belt, and the like.

The washing machine 1*b* may include a drainage device 400. The drainage device 400 may include a drain port 410 and a drain hose 420. For example, the tub 3 and the drain port 410 may be connected through a connection hose 9. However, it is not limited thereto, and the drain port 410 may be directly connected to the tub 3. Alternatively, the drain port 410 may be provided as one component of the tub 3.

The drain hose 420 may be detachably coupled to the drain port 410 in the first direction A. During the drain cycle, wash water in the tub 3 may flow in the second direction B through the drain port 410 and the drain hose 420. Wash water in the tub 3 may be discharged to the outside of the cabinet 2 through the drain port 410 and the drain hose 420.

Because the drain device 40 of the washing machine 1*b* is the same as the drain device 40 of the dishwasher 1*a* described above, a detailed description thereof will be omitted.

As is apparent from the above description, a drain hose and a home appliance may include an improved drain hose coupling structure.

Further, a drain hose may be easily coupled to a drain port without a clamp.

Further, a parting line may not be formed on a surface of a drain hose.

Further, assembly of a drain hose may be improved.

Although a few embodiments of the disclosure have been shown and described, it would be appreciated by those skilled in the art that changes may be made in these embodiments without departing from the principles and spirit of the disclosure, the scope of which is defined in the claims and their equivalents.

What is claimed is:

1. A dishwasher comprising:
a tub;
a drain housing to drain wash water in the tub;
a drain pump detachably coupled to the drain housing, the drain pump configured to pump the wash water;
a drain port formed on one side of the drain housing, the drain port comprising:
a port body to allow the wash water pumped by the drain pump to flow; and
a locking portion; and
a drain hose to drain the wash water discharged from the drain port to an outside of the dishwasher, the drain hose comprising:
a hose body;
a drain connector at one end of the hose body and connectable to the drain port, the drain connector comprising:
a connector body; and
a locking hook extending from the connector body;
a check valve configured to prevent a back flow of the wash water and disposed inside the connector body; and
a holder having a part fixed inside the connector body to fix the check valve,
wherein the locking hook comprises:
a hook body protruding toward the drain port; and
a hooking protrusion formed at one end of the hook body and protruding toward the locking portion of the drain port,
wherein at least a part of the connector body is disposed inside the port body in response to connecting the drain connector to the drain port, and
wherein the locking hook is locked to the locking portion foamed formed on an outer surface of the port body in response to inserting the drain connector into the port body.

2. The dishwasher of claim 1, wherein
the locking portion of the drain port comprises a first inclined portion,
wherein the locking hook of the drain connector comprises a second inclined portion to be moved along the first inclined portion in response to the inserting of the drain connector into the port body of the drain port.

3. The dishwasher of claim 1, wherein
the holder is detachably coupled to one end of the drain connector.

4. The dishwasher of claim 3, wherein the holder comprises:

a holder body disposed inside the drain connector; and a holder flange extending from one end of the holder body to cover at least a portion of the one end of the drain connector.

5. The dishwasher of claim 4, wherein the drain connector further comprises a coupling protrusion protruding from the one end of the drain connector, wherein the holder flange of the holder further comprises a protrusion insertion portion into which the coupling protrusion of the drain connector is inserted.

6. The dishwasher of claim 3, wherein the check valve comprises:

a valve body detachably coupled to an inner surface of the drain connector; and a flap to pivot with respect to the valve body to open or close a drain flow path formed inside the drain connector.

7. The dishwasher of claim 6, wherein the holder comprises:

a holder body disposed inside the drain connector; and a holder flange extending from one end of the holder body, wherein the holder flange comprises:

a first sealing extension portion to be in close contact with the valve body; and a second sealing extension portion to be in close contact with the flap.

8. The dishwasher of claim 7, wherein the holder flange of the holder further comprises a groove portion to be recessed between the first sealing extension portion and the second sealing extension portion.

9. The dishwasher of claim 7, wherein the check valve comprises:

a mounting portion formed on an inner surface of the valve body to be in contact with an end of the first sealing extension portion; and a sealing inclined portion obliquely extending from the mounting portion to be in contact with an outer surface of the first sealing extension portion.

10. A dishwasher comprising:

a tub;

a drain housing to drain wash water in the tub;

a drain pump detachably coupled to the drain housing, the drain pump configured to pump the wash water;

a drain port formed on one side of the drain housing, the drain port comprising:

a port body to allow the wash water pumped by the drain pump to flow; and a locking portion formed on an outer surface of the port body; and a drain hose to drain the wash water discharged from the drain port to an outside of the dishwasher, the drain hose comprising:

a hose body;

a drain connector at one end of the hose body and connectable to the drain port, the drain connector comprising a locking hook to be locked to the locking portion of the drain port in response to inserting the drain connector into the port body of the drain port;

a check valve configured to prevent a back flow of the wash water;

a holder to fix the check valve to an inside of the drain connector and detachably coupled to one end of the drain connector;

a sealer to seal between the drain port and the drain connector, wherein the holder comprises a first side portion disposed on one side of the sealer to limit a movement of the sealer in one direction, and the drain connector further comprises a second side portion disposed on an other side of the sealer to limit a movement of the sealer in a direction opposite to the one direction.

11. A dishwasher comprising:

a tub;

a drain housing to drain wash water in the tub;

a drain pump detachably coupled to the drain housing, the drain pump configured to pump the wash water;

a drain port formed on one side of the drain housing, the drain port comprising:

a port body to allow the wash water pumped by the drain pump to flow; and a locking portion formed on an outer surface of the port body; and a drain hose to drain the wash water discharged from the drain port to an outside of the dishwasher, the drain hose comprising:

a hose body;

a drain connector at one end of the hose body and connectable to the drain port, the drain connector comprising a locking hook to be locked to the locking portion of the drain port in response to inserting the drain connector into the port body of the drain port;

a check valve configured to prevent a back flow of the wash water, the check valve including:

a valve body detachably coupled to an inner surface of the drain connector; and a flap to pivot with respect to the valve body to open or close a drain flow path formed inside the drain connector; and a first coupler formed in a lower portion of one side of the valve body;

a holder to fix the check valve to an inside of the drain connector and detachably coupled to one end of the drain connector, the holder including a second coupler to correspond to the first coupler, wherein the one side of the valve body faces the holder.

12. The dishwasher of claim 11, wherein the check valve further comprises a hinge to connect the valve body with the flap, the hinge formed in an upper portion of an other side that is opposite to the one side of the valve body.

13. The dishwasher of claim 1, wherein the drain port further comprises a guide portion to guide a movement of the drain connector in response to inserting the drain connector into the port body of the drain port, the guide portion to limit a rotation of the drain connector in response to the inserting of the drain connector into the port body of the drain port.

14. The dishwasher of claim 6, wherein the check valve further comprises:

a first sealing protrusion to be in contact with an inner surface of the drain connector to seal between the drain connector and the valve body of the check valve; and a second sealing protrusion to be in contact with an outer surface of the holder to seal between the holder and the valve body of the check valve.

15. The dishwasher of claim 1, wherein the locking hook of the drain connector is locked to the locking portion formed on the outer surface of the port body of the drain port in response to inserting the drain connector into the port body of the drain port and rotating the drain connector with respect to the port body so that the locking hook is engaged with the locking portion.

16. A home appliance comprising:

a main body;

a tub disposed inside the main body to form a washing chamber;

a drain port comprising:

a port body connected to the tub; and a locking portion; and a drain hose to guide wash water inside the drain port to an outside of the home appliance, the drain hose including:

a hose body; and a drain connector disposed at one end of the hose body and coupled to the drain port in a first direction, the drain connector comprising:

a connector body;

a locking hook extending from the connector body;

a check valve configured to open or close a flow path formed in the connector body; and a holder having a part fixed inside the connector body to fix the check valve, wherein the locking hook comprises:

a hook body protruding toward the drain port; and a hooking protrusion formed at one end of the hook body and protruding toward the locking portion of the drain port, wherein at least a part of the connector body is disposed inside the port body in response to coupling the drain connector to the drain port, and wherein the locking hook is locked to the locking portion formed on an outer surface of the port body in a second direction which is opposite to the first direction in response to inserting the drain connector into the port body of the drain port.

17. The home appliance of claim 16, wherein the holder comprises:

a holder body;

a first extension portion formed on one side of the holder body to cover one end of the drain connector; and a second extension portion extending from the first extension portion to cover an outer surface of the drain connector.

18. The home appliance of claim 17, wherein the drain connector further comprises a coupling protrusion extending from the one end of the drain connector, and the holder further comprises a protrusion insertion portion formed in the first extension portion to allow the coupling protrusion to be inserted thereinto.

19. The home appliance of claim 18, wherein the drain connector further comprises a plurality of coupling protrusions which includes the coupling protrusion, and at least one of the plurality of coupling protrusions has a shape different from a rest of the plurality of coupling protrusions.

20. The home appliance of claim 17, further comprising:

a side portion spaced apart from the second extension portion with respect to a flow direction of the wash water and protruding from an outer surface of the drain connector; and a sealer detachably coupled to the outer surface of the drain connector to be disposed between the side portion and the second extension portion.

* * * * *